US007073583B2

(12) United States Patent
Anderton et al.

(10) Patent No.: US 7,073,583 B2
(45) Date of Patent: Jul. 11, 2006

(54) METHOD AND APPARATUS FOR EXPANDING TUBING DOWNHOLE

(75) Inventors: David Andrew Anderton, Hatton of Fintray (GB); Christopher Callaway, Bridge of Don (GB); Alan Mackenzie, Milltimber (GB)

(73) Assignee: e2Tech Limited, Houston, TX (US)

( * ) Notice: Subject to any disclaimer, the term of this patent is extended or adjusted under 35 U.S.C. 154(b) by 181 days.

(21) Appl. No.: 10/451,342

(22) PCT Filed: Dec. 21, 2001

(86) PCT No.: PCT/GB01/05614

§ 371 (c)(1),
(2), (4) Date: Nov. 3, 2003

(87) PCT Pub. No.: WO02/052124

PCT Pub. Date: Jul. 4, 2002

(65) Prior Publication Data

US 2004/0074640 A1 Apr. 22, 2004

(30) Foreign Application Priority Data

Dec. 22, 2000 (GB) ..... 0031409.6
Apr. 24, 2001 (GB) ..... 0109996.9

(51) Int. Cl.
*E21B 23/00* (2006.01)

(52) U.S. Cl. ..... 166/277; 166/313; 166/207

(58) Field of Classification Search ..... 166/277, 166/380, 382, 207, 313
See application file for complete search history.

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | 153/81 |

(Continued)

FOREIGN PATENT DOCUMENTS

CA 2356144 6/2000

(Continued)

OTHER PUBLICATIONS

International Search Report dated Sep. 5, 2002, for application serial No. PCT/GB01/05614.

(Continued)

*Primary Examiner*—William Neuder
(74) *Attorney, Agent, or Firm*—Patterson & Sheridan, L.L.P.

(57) ABSTRACT

Aspects of the invention relate to apparatus and methods for remedial and repair operations downhole. Certain embodiments of apparatus include a lightweight expandable member (22) that can be radially expanded to increased its inner and outer diameters using an inflatable element (34). The lightweight member (22) can be used to repair a fautly safety vavle flapper (12) for example. The invention also relates to lateral tubular adapter apparatus and a method of hanging a lateral from a cased borehole.

16 Claims, 17 Drawing Sheets

U.S. PATENT DOCUMENTS

| | | | | |
|---|---|---|---|---|
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 8/1959 | Hempel | 153/82 |
| 3,087,546 | A | 4/1963 | Woolley | 166/46 |
| 3,195,646 | A | 7/1965 | Brown | 166/208 |
| 3,353,599 | A | 11/1967 | Swift | |
| 3,356,139 | A | 12/1967 | Lamb et al. | 166/119 |
| 3,467,180 | A | 9/1969 | Pensotti | 165/180 |
| 3,477,506 | A | 11/1969 | Malone | 166/207 |
| 3,712,376 | A | 1/1973 | Owen et al. | 166/277 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,429,620 | A | 2/1984 | Burkhardt et al. | 91/395 |
| 4,502,308 | A | 3/1985 | Kelly | 72/58 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,271,472 | A | 12/1993 | Leturno | 175/107 |
| 5,322,127 | A | 6/1994 | McNair et al. | 166/313 |
| 5,409,059 | A | 4/1995 | McHardy | 166/208 |
| 5,417,289 | A | 5/1995 | Carisella | 166/387 |
| 5,435,400 | A | 7/1995 | Smith | 175/61 |
| 5,469,919 | A | 11/1995 | Carisella | 166/387 |
| 5,472,057 | A | 12/1995 | Winfree | 175/57 |
| 5,495,892 | A | 3/1996 | Carisella | 166/387 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 5,901,789 | A | 5/1999 | Donnelly et al. | 166/381 |
| 5,964,288 | A * | 10/1999 | Leighton et al. | 166/207 |
| 6,021,850 | A | 2/2000 | Wood et al. | 166/380 |
| 6,070,671 | A | 6/2000 | Cumming et al. | 166/381 |
| 6,098,717 | A | 8/2000 | Bailey et al. | 166/382 |
| 6,202,748 | B1 | 3/2001 | Carisella et al. | 166/187 |
| 6,325,148 | B1 | 12/2001 | Trahan et al. | 166/297 |
| 6,419,026 | B1 | 7/2002 | MacKenzie et al. | |
| 6,425,444 | B1 | 7/2002 | Metcalfe et al. | 166/387 |
| 6,446,323 | B1 | 9/2002 | Metcalfe et al. | 29/523 |
| 6,457,533 | B1 | 10/2002 | Metcalfe | 166/381 |
| 6,478,091 | B1 | 11/2002 | Gano | 166/373 |
| 6,527,049 | B1 | 3/2003 | Metcalfe et al. | 166/277 |
| 6,543,552 | B1 | 4/2003 | Metcalfe et al. | 175/57 |
| 6,702,029 | B1 * | 3/2004 | Metcalfe et al. | 166/378 |
| 6,742,606 | B1 * | 6/2004 | Metcalfe et al. | 175/57 |
| 6,789,622 | B1 * | 9/2004 | Ducasse et al. | 166/277 |
| 2002/0060069 | A1 * | 5/2002 | Cook et al. | 166/277 |
| 2002/0092648 | A1 | 7/2002 | Johnson et al. | |
| 2002/0166664 | A1 * | 11/2002 | Lauritzen et al. | 166/277 |
| 2002/0166668 | A1 | 11/2002 | Metcalfe et al. | |
| 2003/0136561 | A1 * | 7/2003 | Metcalfe et al. | 166/277 |
| 2004/0069499 | A1 * | 4/2004 | Cook et al. | 166/380 |

FOREIGN PATENT DOCUMENTS

| | | | |
|---|---|---|---|
| DE | 3720486 | * | 3/1988 |
| EP | 0 952 305 | | 10/1999 |
| EP | 0 961 007 | | 12/1999 |
| FR | 2 791 732 | | 10/2000 |
| GB | 1 457 843 | | 12/1976 |
| GB | 2 313 860 | | 12/1997 |
| GB | 2 320 734 | | 7/1998 |
| GB | 2 357 099 | | 6/2001 |
| GB | 2 368 082 | | 4/2002 |
| RU | 2079633 | * | 5/1997 |
| WO | WO 93/24728 | | 12/1993 |
| WO | WO93/25799 | | 12/1993 |
| WO | WO 96/21083 | | 7/1996 |
| WO | WO 99/18328 | | 4/1999 |
| WO | WO 99/23354 | | 5/1999 |
| WO | WO00/37768 | | 6/2000 |
| WO | WO00/37773 | | 6/2000 |
| WO | WO01/98623 | | 12/2001 |
| WO | WO 02/052124 | | 7/2002 |

OTHER PUBLICATIONS

Canadian Examination Report, Canadian Application No. 2356144, dated Oct. 12, 2005.

* cited by examiner 96
92
96
88
94
84
86
96
90
96
82

86b
92
84
88
86s
96
90
96
82
82b 96
92
96
94
88
84
98
96
90
96
82

96
92
96
88
84
98
96
96
90
96
82

METHOD AND APPARATUS FOR EXPANDING TUBING DOWNHOLE

CROSS-REFERENCE TO RELATED APPLICATIONS

This application claims benefit of PCT International application number PCT/GB01/05614 filed on Dec. 21, 2001, entitled "Method and Apparatus," which claims benefit of British application serial number 0031409.6, filed on Dec. 22, 2000, and British application serial number 0109996.9 filed on Apr. 24, 2001.

Aspects of the present invention relate to a method and apparatus for various remedial or repair operations in oil and gas wells. Certain other aspects of the present invention have applications in the context of lateral boreholes.

Aspects of the present invention relate to a method and apparatus for various remedial or repair operations in oil and gas wells. Certain other aspects of the present invention have applications in the context of lateral boreholes.

DESCRIPTION OF RELATED ART

It is known to use expandable tubular members to line or case boreholes that have been drilled into a formation to facilitate the recovery of hydrocarbons. The expandable tubular members are typically of a ductile material so that they can withstand plastic and/or elastic deformation to radially expand their inner diameter (ID) and/or outer diameter (OD). The tubular members can typically sustain a plastic deformation to expand their OD and/or ID by around 10% at least, although radial plastic deformation in the order of 20% or more is possible.

The radial expansion of the tubular members can typically be achieved in one of two ways.

A radial expansion force can typically be applied by an inflatable element (e.g. a packer or other such apparatus that is capable of inflating or otherwise expanding) to a particular portion of the member, so that the inflatable element is inflated within the member to radially expand the member at the particular portion thereof. This can be repeated at one or more locations either adjacent to the particular portion, or spaced therefrom.

Alternatively, an expander device can be pushed or pulled through the member to impart a radial expansion force to the casing so that the ID and/or the OD of the member increases. This is generally called radial plastic deformation in the art, but "radial expansion force" will be used herein to refer to both of these options.

BRIEF SUMMARY OF THE INVENTION

According to a first aspect of the present invention, there is provided a tubular remedial apparatus for performing downhole remedial or repair operations on downhole tubulars such as casing, liner or the like in a wellbore, the apparatus comprising an expandable tubular member and at least one expander element.

According to a second aspect of the present invention, there is provided a method of performing downhole repair or remedial operations, the method comprising the steps of providing an expandable member; locating the member in a tubular in the borehole; providing at least one expander element and locating this within the expandable member; and actuating the expander element to radially expand at least a portion of the expandable member against the wellbore tubular.

The expander element can be integral with the expandable member, or can be separate therefrom.

The expandable member is typically a lightweight member such as a thin-walled tubular member. The wall thickness of the lightweight member is typically up to around 5 millimeters. The lightweight member is typically of stainless steel or an alloy of steel (e.g. a nickel alloy). Alternatively, the expandable member can be a heavyweight tubular having a wall thickness of greater than 5 mm. For lightweight members, the diameter-to-thickness ratio is in the order of 40 to 60, whereas the diameter-to-thickness ratio of a heavyweight expandable tubular member is typically around 20 to 30.

In preferred embodiments, the expandable member comprises a tubular with a central heavyweight portion disposed between two lightweight portions. Optionally, the central heavyweight portion is provided with at least one orifice. This particular expandable member can be used to repair a faulty gas lift valve, for example.

The expandable member is typically a one-piece member. The expandable member can be in the form of a coil or a roll for example. Alternatively, the tubular member can comprise two or more portions that are coupled together (e.g. by welding or screw threads).

Optionally, two axially spaced-apart expander elements can be used. In this embodiment, the elements can be coupled together by a shaft or the like.

The or each expander element typically comprises an inflatable element, such as a packer or the like. However, a mechanical expander device may also be used.

In its broadest context, the method of the second aspect of the present invention facilitates the repair of a damaged or faulty casing, liner or the like. In this embodiment, the expandable member is located in the casing, liner or the like at the damaged or faulty area, and radially expanded so that at least a portion of the member contacts an inner surface of the casing, liner or the like. Thus, the expandable member overlays the damaged or faulty casing, liner etc.

In a particular embodiment of the invention, the method can be used to repair a faulty or damaged valve located in a tubular. In this case, the method comprises the steps of locating the expandable member in a bore of the tubular so that it straddles the valve; locating the expander element in the expandable member at a first portion of the expandable member; actuating the expander element to expand the first portion of the expandable member; de-actuating the expander element; moving the expander element to a second portion of the expandable member; and actuating the expander element to expand the second portion of the expandable member.

The first and second portions of the expandable member typically comprise first and second ends of the expandable member. However, the member need only be expanded on each side of the valve.

Optionally, the method may be used to expand the entire length of the expandable member by de-actuating the expander element and moving it to another location between the first and second portions of the member, and then re-actuating it to expand the expandable member at the other location. The expander element may be moved more than once and expanded at more than one other location.

The valve may comprise a safety valve, chemical injection valve, gas lift valve, sliding sleeve valve or the like.

According to a third aspect of the present invention, there is provided a lateral tubular adapter apparatus, the apparatus having a longitudinal bore and at least one expander element.

According to a fourth aspect of the present invention, there is provided a method of hanging a lateral tubular from a cased wellbore, the method comprising the steps of providing a conduit having a longitudinal bore and at least one expander element, the conduit having an aperture therein; locating the conduit at or near a lateral opening in the casing of the borehole; and expanding the or each expander element to radially expand portions of the conduit on opposite sides of the aperture.

The apparatus preferably has first and second axially spaced-apart expander elements, preferably located on opposite sides of the aperture.

The opening in the borehole typically comprises a lateral borehole.

The conduit is typically a lightweight or heavyweight member as discussed above.

The aperture in the conduit is typically teardrop shaped, but other shapes may also be used, such as ovals, circles, ellipses etc.

The expander element typically comprises an inflatable element as described above. An annular chamber is typically located under a plurality of overlapping metal plates. The annular chamber is typically in fluid communication with the bore of the apparatus, e.g. via one or more ports. An elastomeric covering is typically located over the metal plates. The metal plates typically overlap in the longitudinal direction (i.e. in a direction that is parallel to the longitudinal axis of the apparatus).

The step of actuating the inflatable element typically includes the additional step of providing pressurised fluid in the annular chamber. The pressurised fluid typically expands the metal plates and/or the elastomeric covering.

The inflatable elements typically include one or more ports that are in fluid communication with the annular chamber. The ports typically include a rupture or burst disc therein. The rupture or burst disc is typically rated to burst at around 4000 psi.

The apparatus typically includes a first centraliser located at or near each inflatable element. The first centraliser comprises two or more radially extending blades or the like that engage an inner surface of the conduit. A portion of the first centraliser typically engages at least a portion of the inflatable element. The first centraliser typically engages at least the elastomeric covering of the inflatable element. The first centraliser includes one or more shear screws that retain the first centraliser in a certain axial location with respect to the inflatable element. The first centraliser thus prevents premature inflation of the inflatable element by preventing the elastomeric covering from radially expanding. The shear screws are typically rated to shear at around 500 psi.

The step of inflating the inflatable elements typically includes the additional step of applying a pressure in the annular chamber of the inflatable elements, the pressure being greater than the rating of the shear screws to shear the shear screws of the first centraliser. The shearing of the shear screws typically allows the first centraliser to move axially towards the inflatable element, thus allowing the elastomeric covering to expand. Thus, the first centraliser prevents the inflatable element from prematurely inflating until the shear screws shear.

The apparatus typically includes at least one second centraliser for centralising the conduit on the inflatable elements as the apparatus is run into a borehole. The or each second centraliser typically includes a groove for receiving an O-ring. The O-ring is typically compressed when the inflatable element is expanded. Compression of the O-ring causes the or each centraliser to be retained on the apparatus. Alternatively, the second centraliser comprises a ring of resilient material (e.g. rubber) that engages the conduit, and a retaining clamp. A second centraliser is typically located at a first end of the conduit.

At least a portion of the conduit is typically swaged. The swaged portion is typically at a second end of the conduit. The swaged portion typically engages a least a portion of the apparatus (e.g. one of the inflatable elements). The swaged portion substantially prevents the ingress of dirt, fluids etc into an annulus between the apparatus and the conduit as the apparatus is being run into the borehole. Alternatively, or additionally, a further centraliser may be located at the second end. The or each second centraliser also prevents the ingress of wellbore debris and the like into an annulus between the or each inflatable element and the conduit.

The apparatus typically includes a retainer sub that is located between the first and second inflatable elements. The retainer sub includes a piston that is capable of moving along an axis that is substantially parallel to a longitudinal axis of the apparatus. A surface of the piston is adapted to engage at least one radial piston. Preferably, four radial pistons are provided, each radial piston being circumferentially spaced-apart from the others (e.g. by 90°). The or each radial piston is typically set on an axis that is substantially perpendicular to the longitudinal axis of the apparatus. Movement of the piston in a first direction typically moves the piston to a first configuration in which the surface engages the or each radial piston. The engagement of the piston with the or each radial piston typically causes the or each radial piston to be moved radially outward so that an end thereof engages an inner surface of the conduit. Thus, the conduit is retained in place by the engagement of the or each radial piston therewith. Movement of the piston in a second direction, typically opposite to the first direction, typically moves the piston to a second configuration where the surface disengages the or each radial piston. In this configuration, the or each radial piston can disengage the conduit. The piston is typically held in the first configuration by one or more shear screws. The shear screws are typically rated to shear at around 500 psi.

The method typically includes the additional steps of applying pressure to a first end of the piston to move the piston to the first configuration, and locating the shear screws to retain the piston in the first configuration. The method typically includes the additional steps of applying a pressure to a second end of the piston, the pressure typically being higher than the rating of the shear screws, to move the piston to the second configuration.

The apparatus typically includes a locator. The locator typically facilitates alignment of the aperture in the conduit with the opening to the lateral borehole. In one embodiment, the locator comprises a spring-loaded arm.

The method typically includes the additional step of locating the locating arm in an extended portion of the aperture in the conduit. The extended portion typically comprises an elongate slot. The method typically includes the additional step of running the apparatus into the borehole until the locating arm locates the opening to the lateral borehole.

The apparatus typically includes a ball catcher located at a distal end of the apparatus. The ball catcher typically includes a ball seat that is typically capable of receiving a ball. The ball seat is typically coupled to the ball catcher using one or more shear screws. The shear screws are typically rated to shear at around 3000 psi. The ball seat is movable from a first position where it blocks one or more ports in the apparatus, to a second position where it opens the ports in the apparatus. The ports in the apparatus are typically in fluid communication with the bore of the apparatus.

The method typically includes the additional step of dropping a ball into the borehole before pressure is applied in the bore of the apparatus.

The method typically includes the additional step of applying a pressure to the ball that exceeds the rating of the shear screws to move the ball seat to the second position. This allows the pressure in the bore to be vented into the borehole via the ports. The venting of the pressure allows the inflatable elements to deflate and thus the apparatus can be retrieved from the borehole.

The method optionally includes the additional steps of applying a pressure of around 4000 psi to the bore of the apparatus to rupture the burst discs in the or each inflatable element. This allows the pressure in the bore of the apparatus to be vented outwith the apparatus.

BRIEF DESCRIPTION OF THE SEVERAL VIEWS OF THE DRAWING

Embodiments of the present invention shall now be described, by way of example only, with reference to the accompanying drawings, in which.

DETAILED DESCRIPTION OF THE INVENTION

Figure 1:
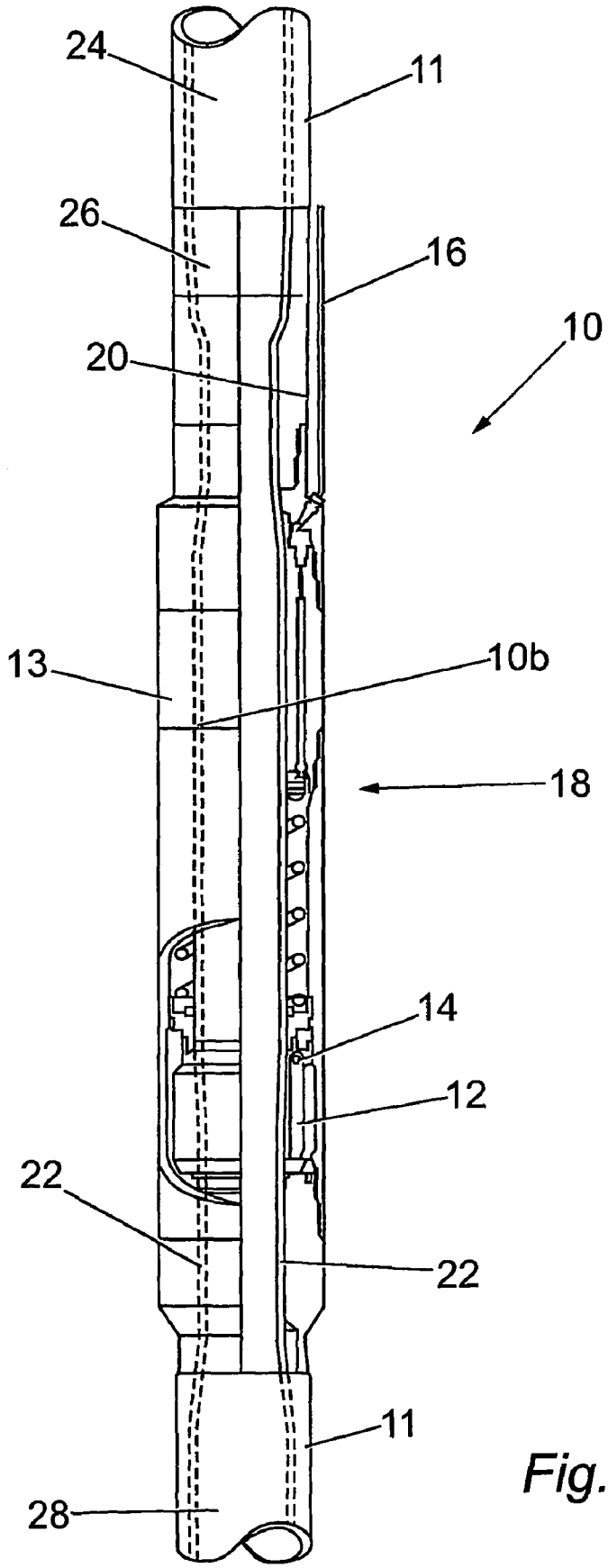
FIG. 1 is a part cross-sectional view of a safety valve that has been repaired using one embodiment of a method according to an aspect of the present invention.

Referring to the drawings, FIG. 1 shows in part cross-section a conventional safety valve, generally designated 10. Safety valve 10 includes a flapper 12 that can be moved from an open position (shown in FIG. 1) to a closed position (not shown). The safety valve 10 is typically located as part of a production string 11 through which fluids (e.g. hydrocarbons) are recovered from a payzone or reservoir (not shown) to the surface.

Safety valve 10 includes a mandrel 13 in which the flapper 12 is located. Mandrel 13 is typically coupled to the production string 11 using any conventional means (e.g. conventional pin and box connections).

In the open position, flapper 12 lies generally parallel to a longitudinal axis of the safety valve 10 and thus does not obstruct the flow of fluids through a bore 10*b* of the safety valve 10. Thus, fluids can flow through the safety valve 10 and the production string 11 to the surface. In the closed position, the flapper 12 is pivoted upwards (with respect to the orientation of the valve 10 in FIG. 1) through 90° around a pivot pin 14 or the like so that the flapper 12 lies substantially perpendicular to the longitudinal axis of the safety valve 10 and thus closes bore 10*b* thereby preventing the flow of hydrocarbons and the like through the valve 10 and the production string 11.

Operation of the safety valve 10 is typically achieved via a control line 16 that extends from the valve 10 back to the surface (not shown). The control line 16 is used to actuate a piston and spring mechanism, generally designated 18, that controls the actuation of the flapper 12 as is known in the art.

It is often the case that the flapper 12 becomes stuck in the closed position and thus prevents fluids from flowing through the production string 11 by blocking the bore 10*b* of the safety valve 10. When this occurs, it is necessary to perform a remedial operation to open the flapper 12 to facilitate the recovery of hydrocarbons.

When the flapper 12 becomes stuck in the closed position, an insert valve (not shown) can be landed on an upper profile 20 (nipple) and the flapper 12 can be controlled using a punch (not shown). The punch provides a jarring action that can be used to punch through into the control line and operate the flapper 12. However, the insert valve can generally only be used when there is mechanical failure of the safety valve 10.

Figure 2C:
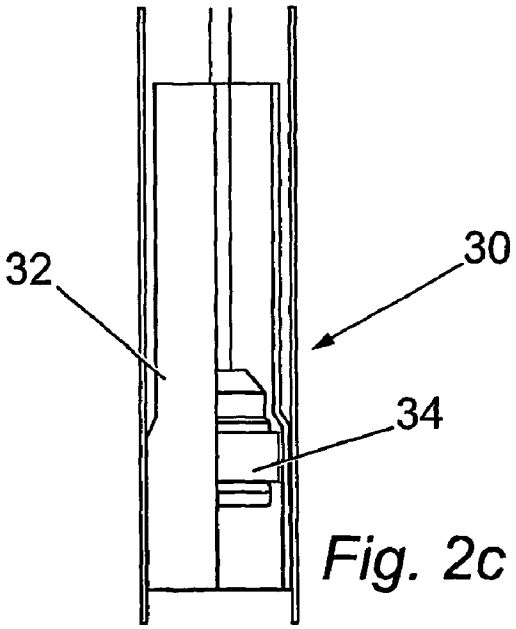
FIGS 2*a* to 2*c* one embodiment of apparatus according to an aspect of the present invention in various stages of expanding a tubular member.

FIG. 2 shows a portion of apparatus, generally designated 30, which can be used to isolate the flapper 12 and lock the flapper 12 in the open position. Apparatus 30 includes a portion of lightweight expandable tubular member 32 (e.g. casing, liner, drill pipe or the like). The lightweight expandable member 32 is generally a thin-walled tubular of up to around 5 mm wall thickness that is typically of stainless steel or an alloy of steel (e.g. a nickel alloy). The force required to radially expand a thin-walled (or lightweight) tubular is typically less than that required to expand a conventional expandable tubular member that typically has a wall thickness of greater than 5 mm. For lightweight pipe, the diameter-to-thickness ratio is in the order of 40 to 60, whereas the diameter-to-thickness ratio of conventional expandable tubular members is around 20 to 30.

It will be appreciated that conventional expandable members could also be used in the present invention, but lightweight pipe will be referred to as it is preferred for certain embodiments, because less rig equipment need be used for the use of lightweight pipe, and the lightweight pipe itself is easier to handle and requires less force to radially expand it. Also, lightweight pipe facilitates bigger expansion ratios so that the pipe can be inserted into the borehole through other conduits that have relatively small IDs and then radially expanded to increase the ID and/or OD of the lightweight pipe.

Figure 2B:
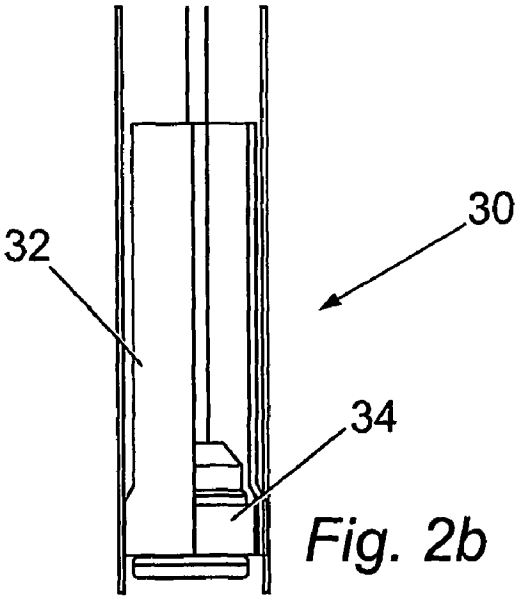
Figure 2A:
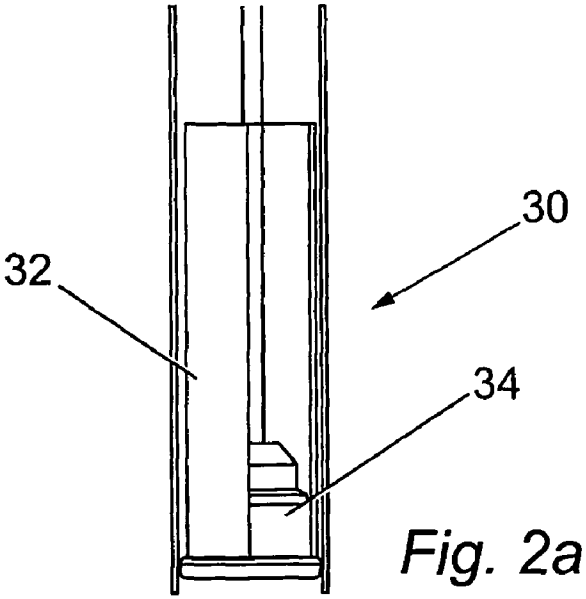

Referring in particular to FIG. 2*a*, an inflatable element 34 can be used to radially expand the lightweight expandable tubular member 32. The inflatable element 34 may be a packer or the like, but can be of any design that is capable of inflating and deflating. The inflatable element 34 is attached to, for example, a coiled tubing string, drill pipe (e.g. a drill string) or a wireline (with downhole pump) or the like so that it can be lowered into the borehole.

The inflatable element 34 is lowered into the borehole through the bore of the lightweight expandable member 32 and then inflated at the required position to radially expand the ID and/or OD of the member 32, as shown in FIG. 2*b*. The inflatable element 34 can then be deflated and moved upwards again to a further portion of the member 32 that is to be expanded, where it can be re-inflated to increase the ID and/or the OD of the member 32 (see the sequence of FIGS. 2*a*, 2*b* and 2*c*). This process can then be repeated until either the entire length of the member 32 is radially expanded, or until certain portion(s) thereof have been expanded, as will be described.

It will be appreciated that the member 32 and the inflatable element 34 can be used to repair a faulty or damaged portion of casing, liner or the like in a borehole. The member 32 can be run into the borehole so that it is located within the damaged or faulty portion of the pre-installed casing, liner or the like. Thereafter, the inflatable element 34 is located within the member 32 at a first location (typically one end of the member) and then inflated to expand the member at this first location. The inflatable element 34 is then deflated and moved to a second location, spaced-apart from the first location, and then re-inflated to expand the member 32 at the second location. The second location may be at the opposite end of the member 32. This process can be repeated until the entire length of the member 32 is radially expanded into contact with the damaged or faulty casing, liner or the like if required. Thus, the member 32 overlays the damaged or faulty portion of the pre-installed casing, liner or the like.

Referring again to FIG. 1, there is shown a portion of lightweight expandable tubular member 22 that has been inserted through the bore 10*b* of the safety valve 10. Note that the member 22 has been shown in FIG. 1 as having portions thereof that have been radially expanded. It will be appreciated that the OD of the member 22 is less than the diameter of the bore 10*b* and the diameter of the throughbore (not shown) of the production string 11 so that it can be passed from the surface through the string 11 and into the bore 10*b* of the valve 10.

As the unexpanded expandable member 22 is passed through the bore 10*b*, it engages the flapper 12 and pushes it back to the open position as shown in FIG. 1. Once the unexpanded expandable member 22 has been located in the correct position, the inflatable element 34 (FIG. 2) is lowered on a wireline or the like into the member 22 so that the inflatable element 34 is located within the bore of the member 22. The inflatable element 34 is typically positioned at or near an upper end of the member 22 and then inflated to radially expand the member 22 at the upper end. It will be noted that "upper" and "lower" are being used with respect to the orientation of the safety valve 10 in FIG. 1, but this is arbitrary.

The radial expansion of the member 22 causes an outer surface thereof to engage an inner surface of the production string 11 to provide a first expanded portion 24. The inflatable element 34 is then deflated and can be moved downwardly to a second location that is below but adjacent to the first expanded portion 24. The inflatable element 34 is then re-inflated to provide a second expanded portion 26 in the same manner as the first expanded portion 24. It will be appreciated that the first and second expanded portions 24, 26 may be expanded at the same time, depending upon the length of the inflatable element 34 in a direction that is parallel to the longitudinal axis of the safety valve 10. Indeed, the length of the member 22 that is radially expanded by the inflatable element 34 is generally dependent upon the length of the element 34.

It will also be appreciated that only the first expanded portion 34 may be required to keep the member 22 in position. Thus, the inflatable element 34 may need to be inflated only once at the upper end.

Once the upper portions 24, 26 have been expanded, the inflatable element 34 is then lowered through the member 22 to a third location, typically at a lower end of the member 22. At the third location, the inflatable element 34 is then re-inflated to expand the member 22 to provide a third expanded portion 28. Again, the inflatable element 34 can be deflated, moved to a different location, and re-inflated to produce various expanded portions where the member 22 has been radially expanded. Indeed, the inflatable element 34 can be used to radially expand the entire length of the member 22 so that an outer surface thereof engages either an inner surface of the production string 11 or the bore 10*b* of the safety valve 12, but this is not necessary.

It will be appreciated that the member 22 need not be expanded at the upper and lower ends thereof, as the member 22 need only be expanded on each side of the flapper 12.

Thus, the flapper 12 is held in the open position by the overlay of the lightweight expandable tubular member 22 that pushes the flapper 12 back and keeps it in the open position. Heavyweight pipe may also be used where the inflatable element 34 is capable of exerting sufficient force to expand heavyweight pipe.

It will also be appreciated that the member 22 can be radially expanded at each end simultaneously by using two axially spaced-apart inflatable elements 34 that are coupled, for example, by a shaft (not shown in FIG. 1). The length of the shaft will be dependent upon the length of the expandable member 22 that is to be located in the bore 10*b* of the safety valve 10.

It will further be appreciated that locking the flapper 12 of the safety valve 10 in the open position allows hydrocarbons to be recovered, but it will generally be necessary to install another safety valve elsewhere in the production string 11.

Figure 3:
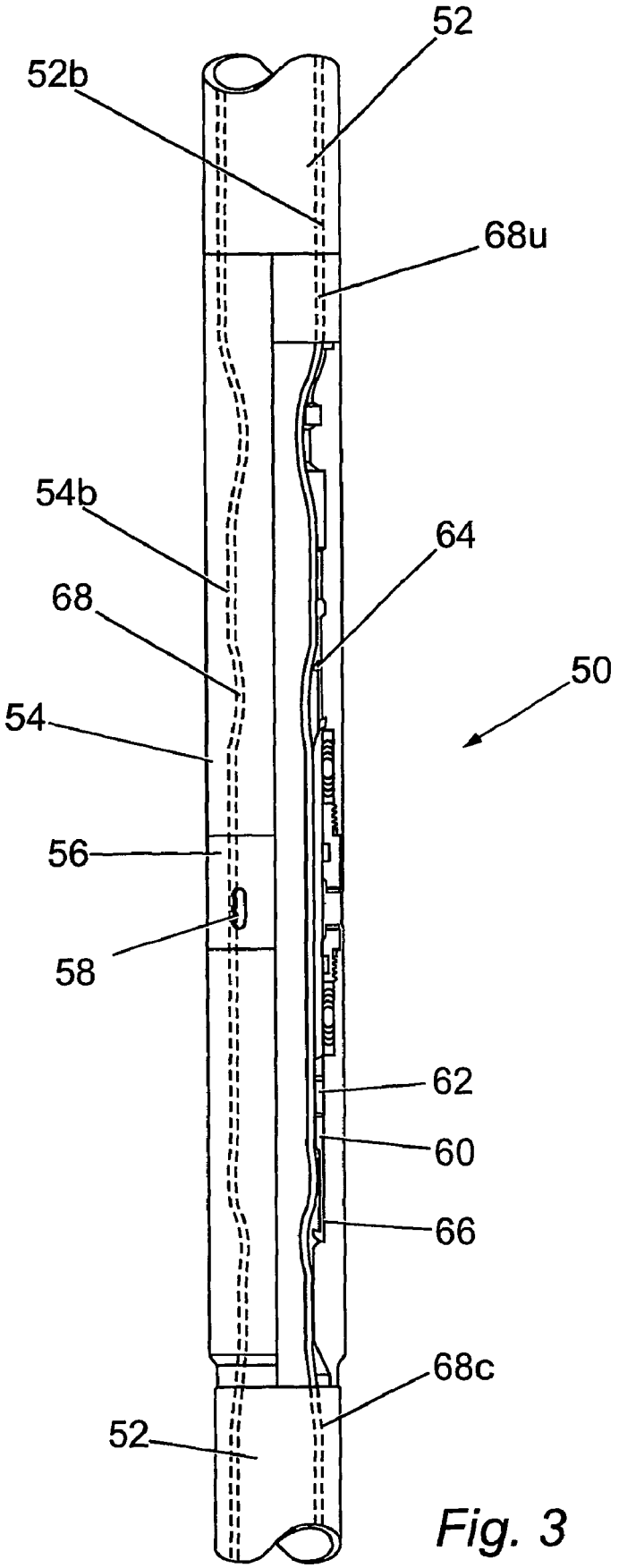
FIG. 3 is a part cross-sectional view of a sliding sleeve that has been repaired using one embodiment of a method according to an aspect of the present invention.

Referring now to FIG. 3, there is shown a sliding sleeve valve 50 that is typically used to establish communication between a tubing string 52 and an annulus (not shown) between the tubing string 52 and a casing or liner (not shown). Sliding sleeve valve 50 includes a mandrel 54 that is provided with attachment means (e.g. conventional pin and box screw thread connectors) so that the valve 50 can be incorporated as part of the tubing string 52.

Mandrel 54 includes a perforated portion 56 that includes a plurality of circumferentially spaced-apart ports 58. A sleeve 60 is located within mandrel 54 that can slide substantially parallel to a longitudinal axis of the sliding sleeve valve 50. Sleeve 60 is provided with one or more ports 62 that are similar to the ports 58 in the mandrel 60.

The operation of the sliding sleeve valve 50 is well known in the art, and typically uses a wireline shifting tool that has dogs that engage an upper profile 64 so that the sleeve 60 can be pulled upwards to align the ports 62 with the ports 58. The wireline shifting tool is typically turned upside down so that the dogs engage a lower profile 66 to move the sleeve 60 downwards so that the ports 62 are no longer aligned with ports 58.

The sleeve 60 can sometimes become stuck in the open position (i.e. where the ports 58, 62 are aligned). Also, when the ports 62 are mis-aligned with the ports 58 (i.e. when the sleeve 60 is moved downwards) there can sometimes be leakage of production fluids that can be lost into the annulus.

A lightweight expandable member 68 can be used to isolate the sliding sleeve valve 50 by blocking the ports 58 in the mandrel 54. The expandable member 68 is inserted through a bore 54*b* in mandrel 54 and through bore 52*b* of the tubing string 52, as shown in FIG. 3. Thereafter, the inflatable element 34 is used to radially expand at least upper and lower portions 68*u*, 68*l* of the member 68 as described above. It will be noted that the member 68 has been radially expanded over much of its length in FIG. 3, although this is not necessary. The radial expansion of the upper and lower portions 68*u*, 68*l* provides a metal-to-metal seal with the mandrel 54 and/or the tubing string 52 and thus fluid flows through the member 68 to the surface.

Thus, the member 68 prevents any fluid being lost through ports 58, 62 to the annulus, and blocks the ports 58.

It will again be appreciated that a heavyweight expandable tubular member could be used in place of the lightweight one, providing the inflatable element 34 is capable of exerting sufficient force to expand the heavyweight member.

It will also be appreciated that the upper and lower ends 68*u*, 68*l* of the member 68 could be expanded simultaneously using two axially spaced-apart inflatable elements 34 that are coupled together. The member 68 need not be expanded along its entire length and can merely be expanded at or near the upper and lower ends 68*u*, 68*l* (or any other convenient location) to close off and seal the sliding sleeve valve 50.

Figure 4:
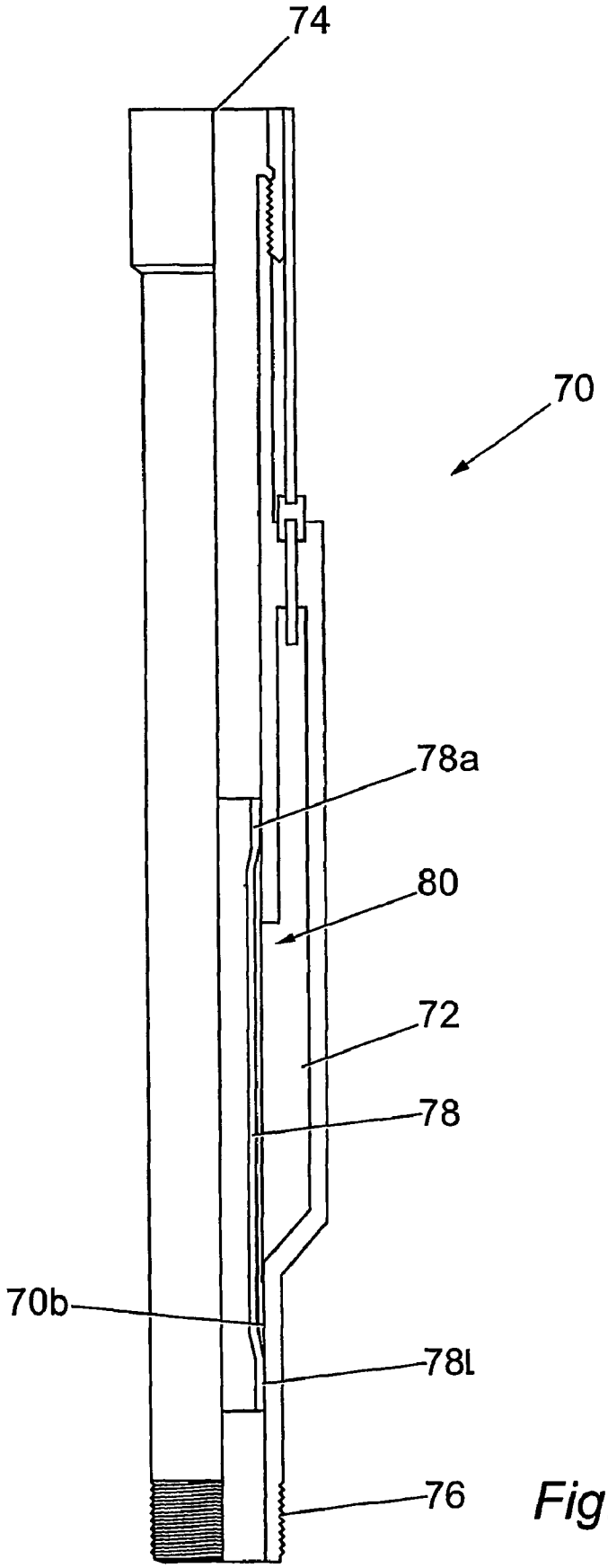
FIG. 4 is a part cross-sectional elevation of a mandrel valve that houses a gas lift valve that has been repaired using one embodiment of a method according to an aspect of the present invention.

Referring now to FIG. 4, there is shown a side pocket mandrel 70 that is a tubing-mounted accessory having a side pocket 72 that can receive a number of different valve assemblies. The side pocket 72 is typically located on the outer diameter of the mandrel 70. The mandrel 70 is provided with attachment means 74, 76 at the ends thereof so that the mandrel 70 can be included as part of e.g. a production string (not shown). The attachment means 74, 76 typically comprise conventional pin and box connectors.

The valve assembly that can be installed in the side pocket 72 may be of any conventional type, such as a chemical injection valve (not shown) or a gas lift valve (not shown) for example. The valve assembly is typically installed in and removed from the side pocket 72 using a wireline (not shown).

In the event that the valve assembly in side pocket 72 fails to operate correctly, a portion of lightweight (or heavyweight) expandable member 78 can be used to straddle an opening 80 that allows the valve assembly to communicate with a bore 70*b* of the mandrel 70. The valve assembly is typically removed first before the expandable member 78 is located in place, although this is not always necessary.

The inflatable element 34 can then be used to radially expand an upper portion 78*u* and a lower portion 78*l* of the member 78 as described above, optionally simultaneously. The member 78 thus straddles the opening 80 and prevents any fluids flowing through the mandrel 70 from being lost. The inflatable element 34 can be used to expand any selected portions of the member 78, or indeed expand it over its entire length.

Where a gas lift valve assembly is used, the member 78 may contain a fixed diameter orifice that will allow gas to be injected from the annulus. Gas lift is a form of enhanced recovery where gas is injected at pressure down the annulus. The side pocket 72 of the mandrel 70 would contain a gas lift valve that is set to open at a certain pressure (typically in the range of between 2000 and 3000 psi). When the pressure in the annulus reaches the pressure that the gas lift valve is set to open at, the valve opens (typically against a spring bias) and allows gas to enter the mandrel 70 and thus the tubing or production string. The gas mixes with the recovered hydrocarbons in the string, thus reducing its density and causing the hydrocarbons to rise to the surface. The injected gas is separated from the hydrocarbons at the surface and re-injected to continue the process. Alternatively, or additionally, the injected gas forms bubbles in the fluids that rise to the surface, sweeping the fluids with them.

It may not be desirable to completely seal off the gas lift valve using a portion of lightweight or heavyweight expandable member as shown in FIG. 4. Referring to FIG. 5, there is shown a schematic representation of the gas lift valve. The valve is represented by a portion of tubing 82 that is provided with a perforation 84. The perforation 84 represents the gas lift valve that allows gas from the annulus to be injected into the tubing 82.

An expandable tubular member 86 that includes a central heavyweight portion 88 and two lightweight end portions 90, 92 is used to isolate the perforation 84 (i.e. the faulty gas lift valve), but can still provide a path for injected gas. The path is provided by a hardened orifice 94 in the heavyweight portion 88.

The two end portions 90, 92 may be provided with a coating of a friction and/or sealing material 96 to provide a good anchor and/or seal between the expandable tubular member 86 and the tubing 82. It will be appreciated that members 22, 32, 68 and 78 of the previous embodiments may similarly be provided with a friction and/or sealing material 96.

The friction and/or sealing material 96 is typically a rubber material and may comprise first and second bands that are axially spaced-apart along a longitudinal axis of the member 86. The first and second bands are typically axially spaced by some distance, for example 3 inches (approximately 76 mm).

The first and second bands are typically annular bands that extend circumferentially around an outer surface 86*s* of the member 86, although this configuration is not essential. The first and second bands typically comprise 1-inch wide (approximately 26 mm) bands of a first resilient material (e.g. a first type of rubber). The material 96 need not extend around the full circumference of the surface 86*s*.

Located between the first and second bands is a third band (not shown) of a second resilient material (e.g. a second type of rubber). The third band preferably extends between the first and second bands and is thus typically 3 inches (approximately 76 mm) wide.

The first and second bands are typically of the same depth as the third band, although the first and second bands may be of a slightly larger depth.

The first type of rubber (i.e. first and second bands) is preferably of a harder consistency than the second type of rubber (i.e. third band). The first type of rubber is typically 90 durometer rubber, whereas the second type of rubber is typically 60 durometer rubber. Durometer is a conventional hardness scale for rubber.

The particular properties of the rubber or other resilient material may be of any suitable type and the hardnesses quoted are exemplary only. It should also be noted that the relative dimensions and spacing of the first, second and third bands are exemplary only and may be of any suitable dimensions and spacing.

An outer face of the bands can be profiled (e.g. ribbed) to enhance the grip of the bands on the tubing 82. The ribs also provide a space into which the rubber of the bands can extend or deform into when the member 86 is expanded, as rubber is generally incompressible.

The two outer bands being of a harder rubber provide a relatively high temperature seal and a back-up seal to the relatively softer rubber of the third band. The third band typically provides a lower temperature seal.

The two outer bands of rubber can be provided with a number of circumferentially spaced-apart notches (not shown) e.g. four equidistantly spaced notches can be provided. The notches generally do not extend through the entire depth of the rubber bands and are typically used because the first and second bands are of a relatively hard rubber material and this may stress, crack or break when the member 86 is radially expanded. The notches provide a portion of the bands that is of lesser thickness than the rest of the bands and this portion can stretch when the member 86 is expanded. The stretching of this portion substantially prevents the bands from cracking or breaking when the member 86 is expanded. The notches can also provide a space for the rubber to deform or extend into as it is compressed.

Alternatively, the material 96 may be in the form of a zigzag. In this embodiment, the material 96 comprises a single (preferably annular) band of resilient material (e.g. rubber) that is, for example, of 90 durometers hardness and is about 2.5 inches (approximately 28 mm) wide by around 0.12 inches (approximately 3 mm) deep.

To provide a zigzag pattern and hence increase the strength of the grip and/or seal that the material 96 provides in use, a number of slots (e.g. 20 in number) are milled into the band of rubber. The slots are typically in the order of 0.2 inches (approximately 5 mm) wide by around 2 inches (approximately 50 mm) long.

The slots are milled at around 20 circumferentially spaced-apart locations, with around 18° between each along one edge of the material 96. The process is then repeated by milling another 20 slots on the other side of the material 96, the slots on the other side being circumferentially offset by 9° from the slots on the first side. The slots also provide a space for the rubber to deform or extend into when the member 86 is expanded.

Figures 5A, 5B, 5C, 5D:
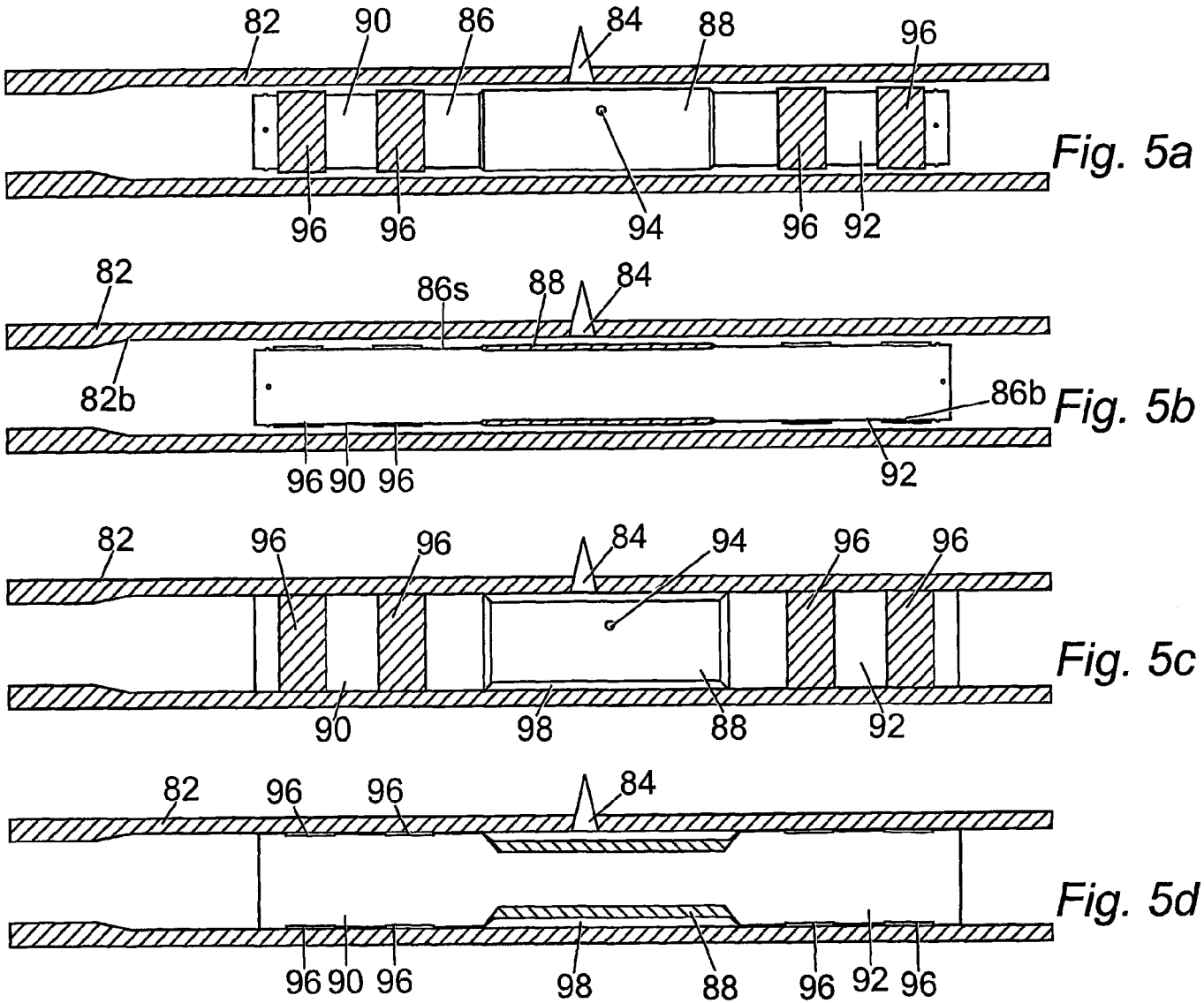
FIGS 5*a* to 5*d* are four cross-sectional elevations of a gas lift orifice showing the stages of repair.

FIGS. 5*a* and 5*b* show the expandable tubular member 86 located in the tubing 82 before it has been expanded. The inflatable element 34 is used to apply a radial expansion force to the lightweight portions 90, 92 only to expand them into contact with an inner surface of the tubing 82, as shown in FIGS. 5*c* and 5*d*. The inflatable element 34 is located on a coiled tubing string, drill string, wireline (with downhole pump) or the like and passed through a bore 82*b* of the tubing 82 and a bore 86*b* of the member 86 to the required position. Thereafter, the inflatable element 34 is inflated to radially expand the portions 90, 92. It will be appreciated that the inflatable element 34 may have to be deflated, moved and then re-inflated to expand the length of the lightweight portions 90, 92. This is of course dependent upon the length of the portions 90, 92 and the length of the inflatable element 34.

The portions 90, 92 can also be expanded simultaneously by providing two inflatable elements 34 that are axially spaced-apart as described above.

As can be seen from FIGS. 5*c* and 5*d*, the friction and/or sealing material 96 comes into contact with the tubing 82 when the portions 90, 92 have been radially expanded. The material 96 generally enhances the grip that the member 86 has on the tubing 82 and can also be used as a seal.

The heavyweight portion 88 of member 86 is not expanded so that there is an annulus 98 between the heavyweight portion 88 and the tubing 82. Gas from the orifice 84 (i.e. the gas that has been injected through the gas lift valve) flows into the annulus 98 and through the hardened orifice 94 in the heavyweight portion 88. The orifice 94 thus allows gas to be injected to enhance the recovery of hydrocarbons.

It will be appreciated that the gas injection cannot be controlled as well as with a gas lift valve, but the orifice 94 allows gas to be mixed with the hydrocarbons to facilitate their recovery.

It will also be appreciated that a similar member 86 can be used to isolate a faulty or inoperative chemical injection valve or the like.

Figure 6B:
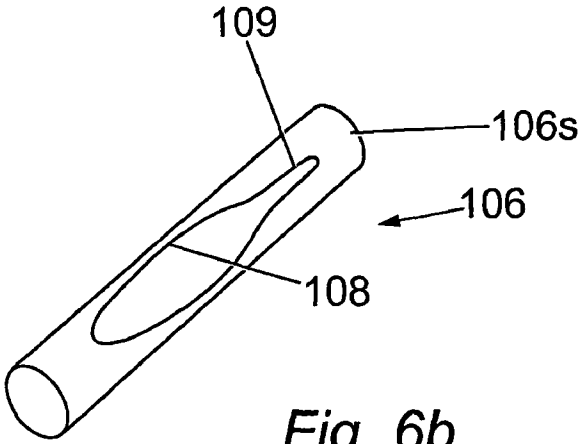
FIG. 6*b* shows a perspective view of a conduit for use with one embodiment of apparatus according to an aspect of the present invention.
Figure 6A:
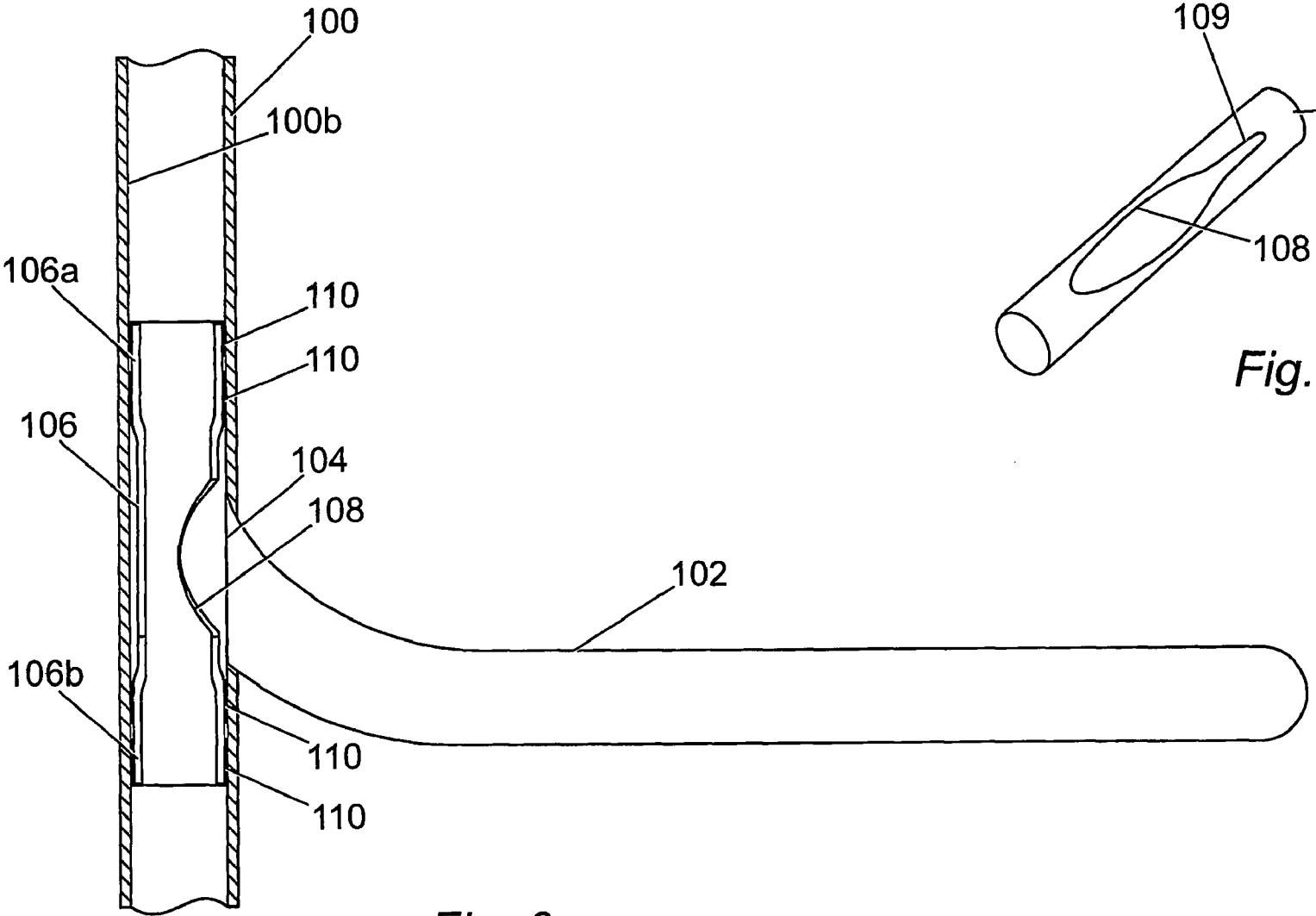
FIG. 6*a* shows a part cross-sectional elevation of a casing and a lateral borehole that has been provided with a portion of one embodiment of apparatus according to an aspect of the present invention.

Referring to FIG. 6*a*, there is shown a portion of pre-installed casing 100 that has a lateral borehole 102 drilled through a side thereof in a known manner. Casing 100 is typically a 9 and five eighths inch casing (approximately 245 mm), and the lateral borehole 102 is typically 8½ inches (approximately 216 mm) in diameter.

When drilling the lateral borehole 102, a milled casing exit or opening 104 is formed at or near the casing 100. The opening 104 is typically drilled or milled at an angle to the longitudinal axis of the casing 100, and the opening 104 that is formed is typically a rough hole in the surrounding formation and the casing 100.

Conventionally, a hook hanger (not shown) is landed at or near the opening 104 that has a flange (not shown) that mates with the opening 104. However, the flange is generally not a good fit with the opening 104 as the opening 104 is generally not a precise opening in the casing 100 and formation, and is not usually of precise and constant dimensions and shape. When the flange is presented to the opening 104, sand etc can get around the side of the flange that falls into the main bore 100*b* through casing 100 and can block the main bore 100*b* thus restricting or preventing the flow of hydrocarbons to the surface. The sand can also cause the blockage of lower lateral boreholes.

The sand also causes other difficulties, such as blocking the inlets to downhole pumps and the like, and if the sand enters downhole apparatus such as pumps, it can cause components within the apparatus to wear out or otherwise fail. Furthermore, the contamination of the recovered hydrocarbons with sand and the like necessitates sand management at the surface to sift out or otherwise remove the sand from the recovered hydrocarbons, and can also necessitate sand clean-out trips.

In order to prevent the sand etc from sifting into the bore 100*b*, a conduit 106 (best shown in FIG. 6*b*) is located between the flange on the hook hanger and the rough opening 104. Conduit 106 comprises a portion of, for example, lightweight expandable member that has an elongate or tear-shaped aperture 108. In use, and as shown in FIG. 6*a*, aperture 108 in conduit 106 is aligned (approximately) with opening 104. Thereafter, end portions 106*a*, 106*b* of conduit 106 are radially expanded to provide a coupling between the conduit 106 and the casing 100. An outer surface 106*s* of the conduit 106 can be provided with a friction and/or sealing material 110, similar to material 96 described above, to enhance the grip of the conduit 106 on the casing 100 and to provide a seal that prevents the ingress of sand etc into the main bore 100*b*.

It will be appreciated that the material 110 may not be required as the radial expansion of the ends 106*a*, 106*b* of the conduit 106 will provide a metal-to-metal seal by contact of the outer surface 106*s* with the bore 100*b*.

Referring now to FIGS. 7*a* to 7*i*, there is shown in part cross-section an apparatus 150 that is particularly suitable for expanding end portions 106*a*, 106*b* of the conduit 106. For clarity, the left-hand side of FIG. 6*b* is a continuation of the right hand side of FIG. 6*a* and so on. Conduit 106 can be either a heavyweight or a lightweight member, but is preferably a lightweight member. The aperture 108 in conduit 106 can be seen in FIGS. 7*c* to 7*g*. Aperture 108 is shaped and sized to conform generally to the opening 104 in the casing 100.

Figure 7A:
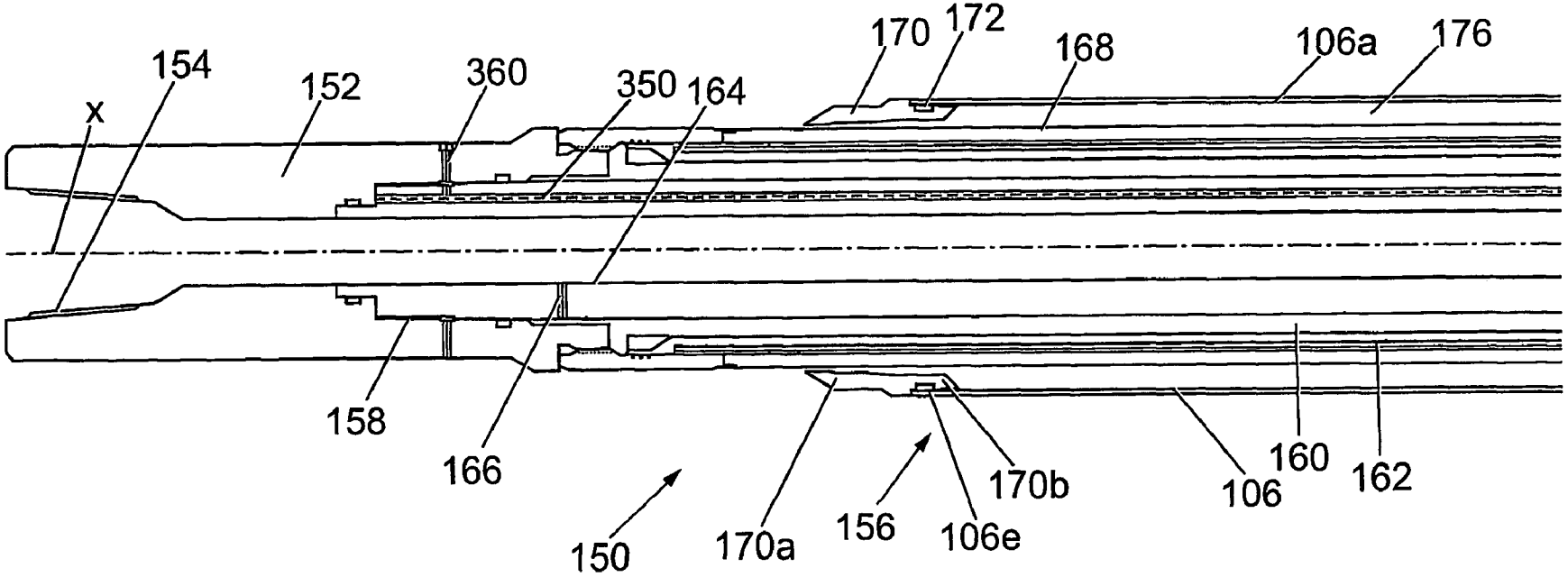
FIGS 7*a* to 7*i* are cross-sectional elevations that together show an embodiment of apparatus according to an aspect of the present invention.

Referring to FIG. 7*a*, apparatus 150 includes a connector sub 152 that is provided with a conventional box connection 154 to allow the apparatus 150 to be coupled to a drill string, coiled tubing string, wireline or the like.

An inflatable element that typically comprises a packer 156 is threadedly coupled to the connector sub 152 at threads 158. Packer 156 includes an annular chamber 160 that is located below a plurality of overlapping metal plates 162. The metal plates 162 typically overlap in the longitudinal direction (i.e. in a direction that is parallel to a longitudinal axis x of the apparatus 150). The annular chamber 160 is in fluid communication with a longitudinal bore 164 of the apparatus 150 via a port 166. An elastomeric covering 168 is located over the metal plates 162.

Figure 8:
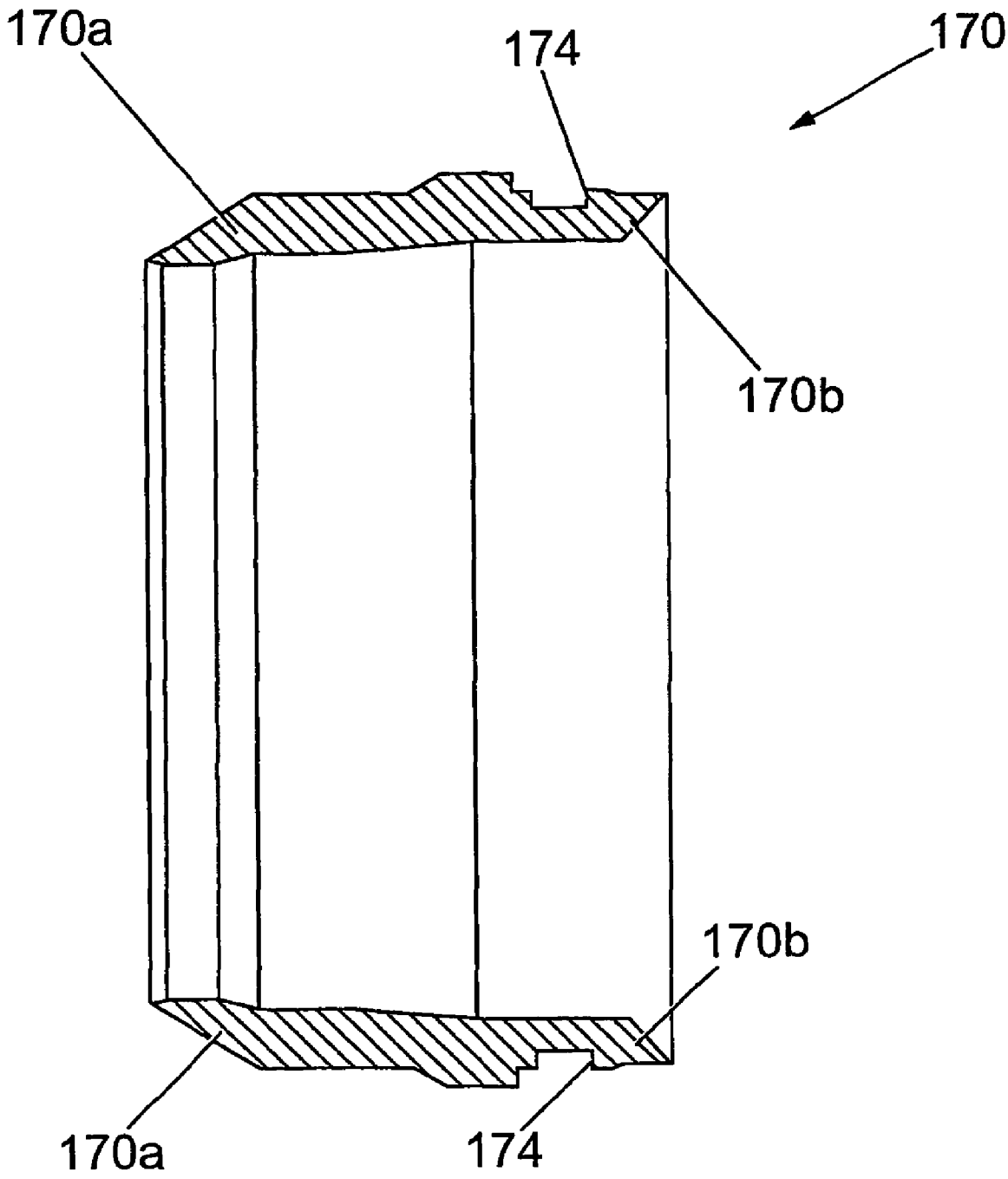
FIG. 8 shows an enlarged view of a centraliser forming part of the apparatus of FIG. 7*a*.

A centraliser 170, best shown in FIG. 8, is located over the elastomeric covering and engages an end portion 106*e* of the conduit 106. The centraliser 170 is typically of TEFLON™, although it may also be of rubber or any other suitable material. An O-ring 172 is located in a groove 174 on the centraliser 170 and thus retains the conduit 106 in contact with the apparatus 150, and also retains the centraliser 170 in position on the apparatus 150 and the conduit 106. In particular, the centraliser 170 keeps the conduit 106 centralised as the apparatus 150 and conduit 106 are run into the hole, and also provides a coupling between the apparatus 150 and conduit 106. The centraliser 170 also serves to prevent the ingress of contaminants (e.g. dirt etc) from entering an annulus 176 between the elastomeric covering 168 and the conduit 106. This is particularly the case when the apparatus 150 is being withdrawn from the casing 100 before the apparatus 150 is operated to expand the end portions 106*a*, 106*b* of the conduit 106.

Figure 9:
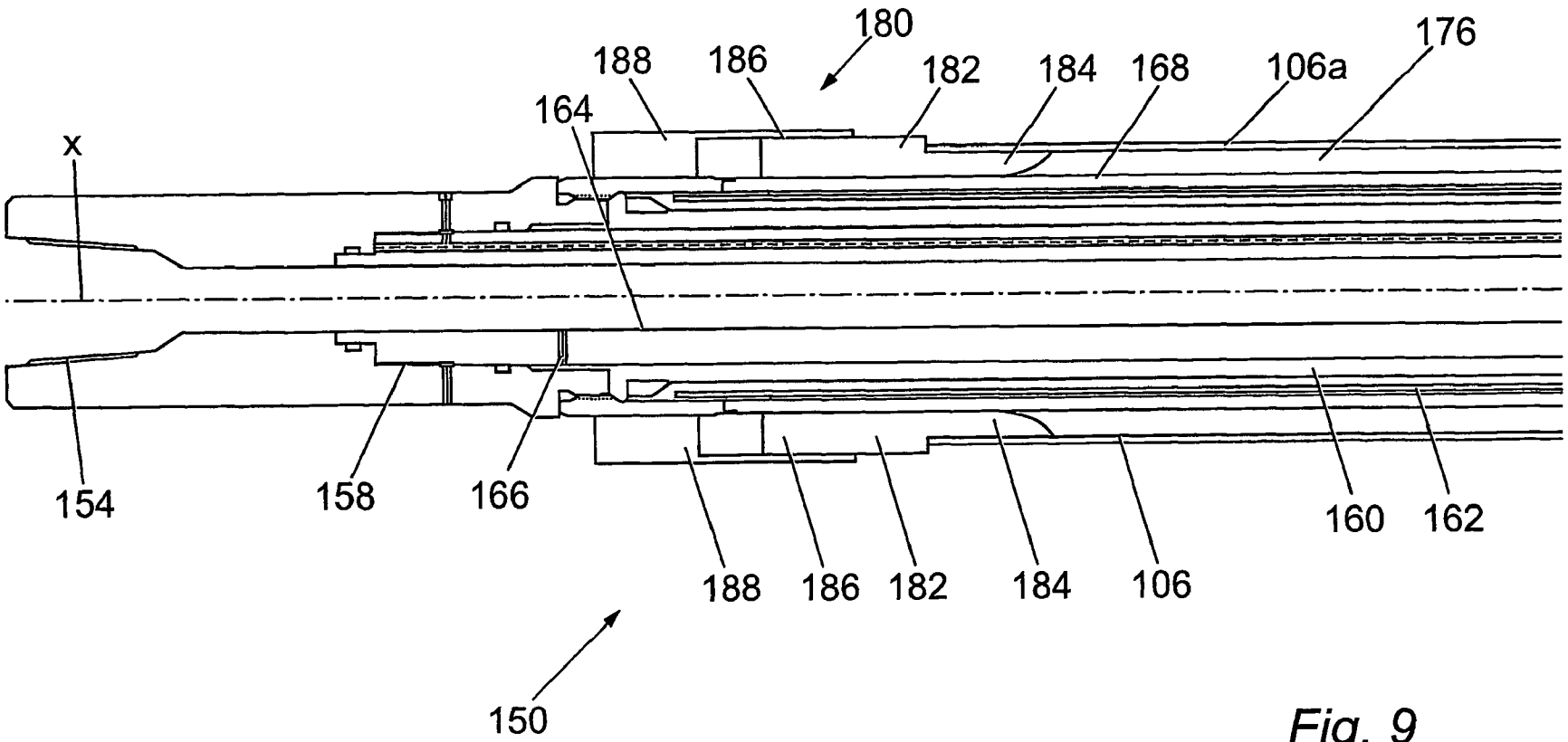
FIG. 9 shows a similar view of the apparatus of FIG. 7*a* with an alternative centraliser.

FIG. 9 shows a view of the apparatus 150 of FIG. 7*a*, but the apparatus 150 is provided with an alternative centraliser 180. The centraliser 180 comprises a rubber ring 182 that is typically of 90 durometers hardness, although other hardnessess may be used. A first end 184 of the rubber ring 182 is located in the annulus 176 between the elastomeric covering 168 and the conduit 106. A metal or other clamp 188 is used to hold the rubber ring 182 in place.

Referring again to FIG. 7*b*, a second centraliser 190 is threadedly engaged with the packer 156 using threads 192. The second centraliser 190 is used to ensure that the conduit 106 remains central on the apparatus 150 as it is run into the casing 100. The second centraliser 190 is provided with shear screws 194 (two shown in FIG. 7*b*) that are set to shear at a particular pressure (e.g. 500 psi). A port 196 that communicates with the bore 164 of the apparatus 150 is provided in the second centraliser 190, and a burst disc 198 is located in the port 196. The burst disc 198 is set to rupture at a pressure of around 4000 psi, and is used for the release of pressure in an emergency as will be described.

The shear screws 194 that are set to shear at around 500 psi, also ensure that the packer 156 does not prematurely inflate. This is because the second centraliser 190 cannot move as it is retained in position by the shear screws 194, and thus the elastomeric covering 168 cannot be axially displaced, thereby preventing the packer 156 from inflating.

Figure 7B:
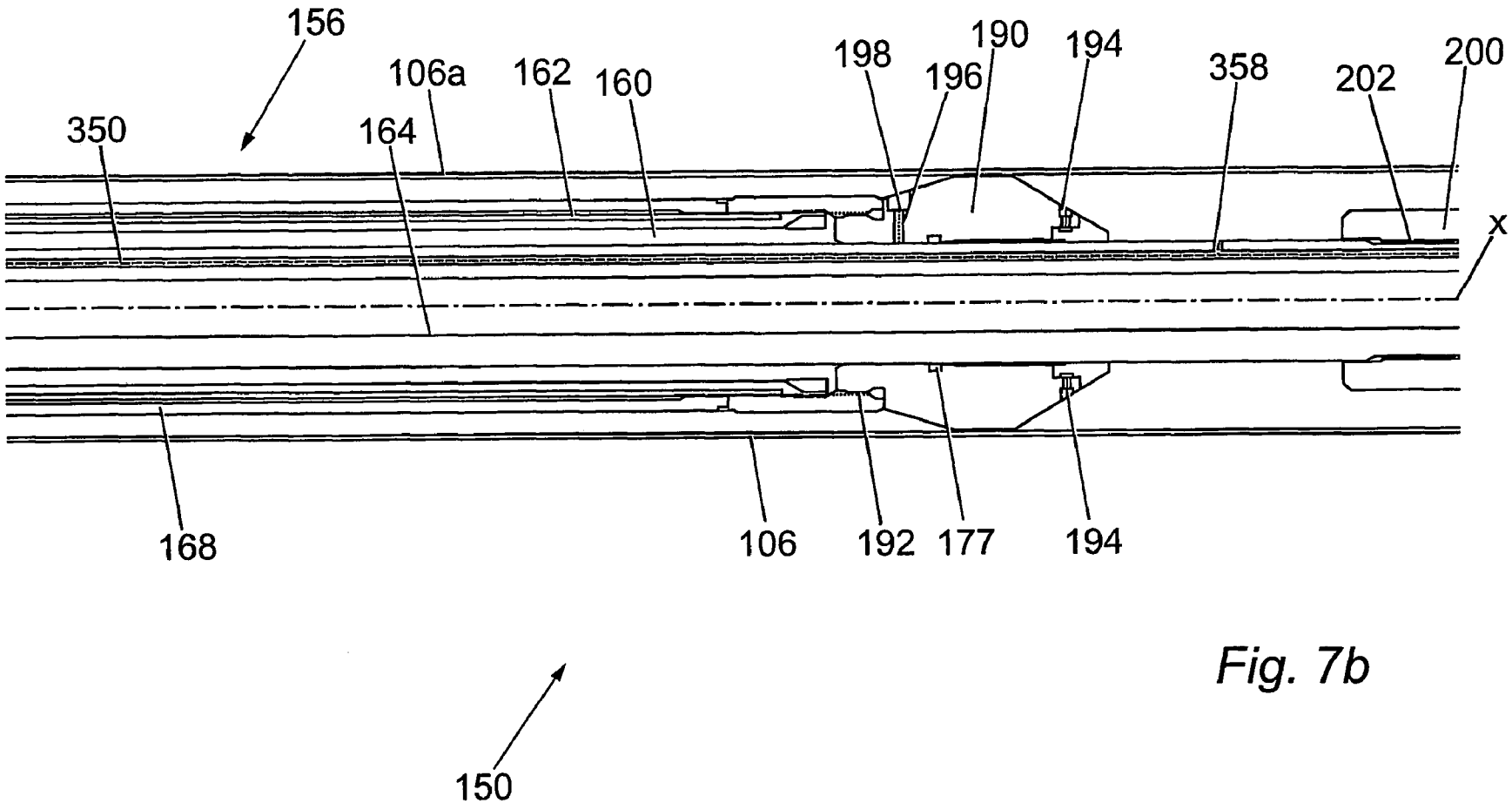
Figure 7C:
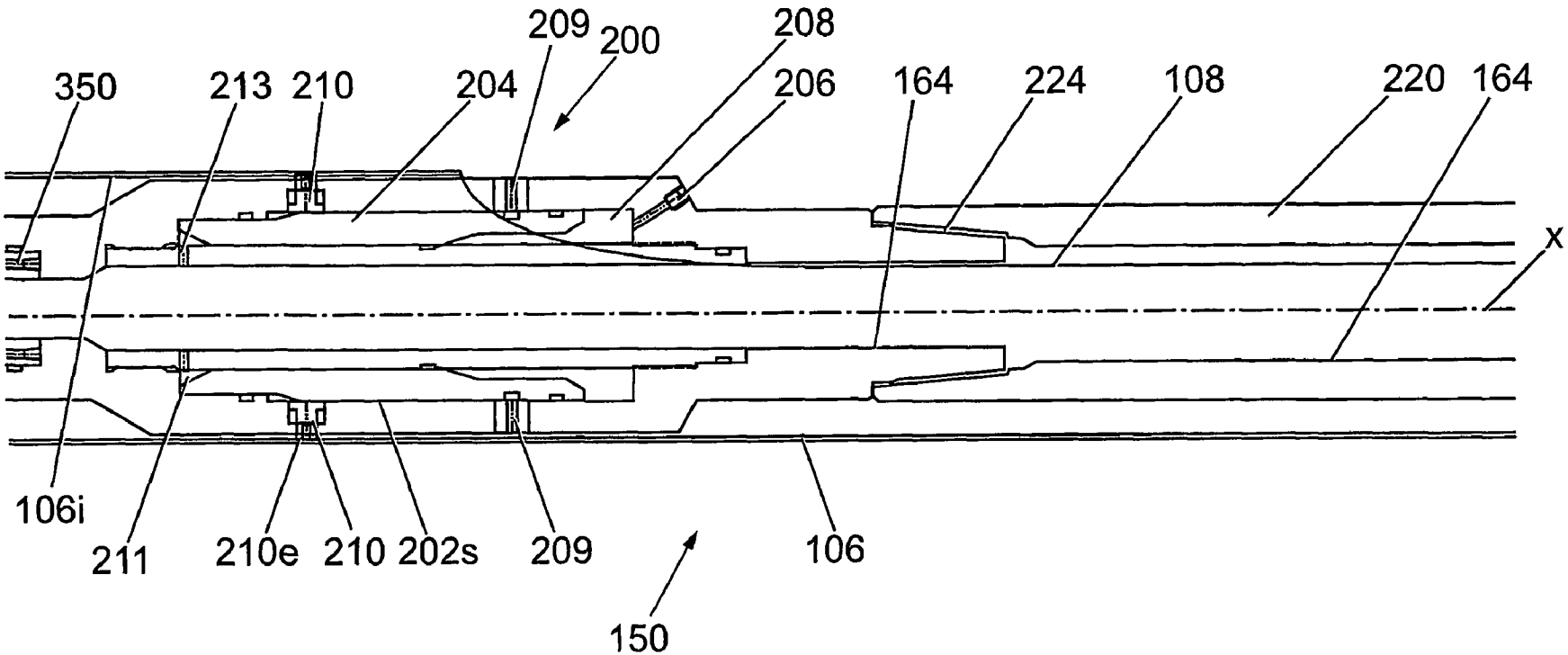
Figure 7D:
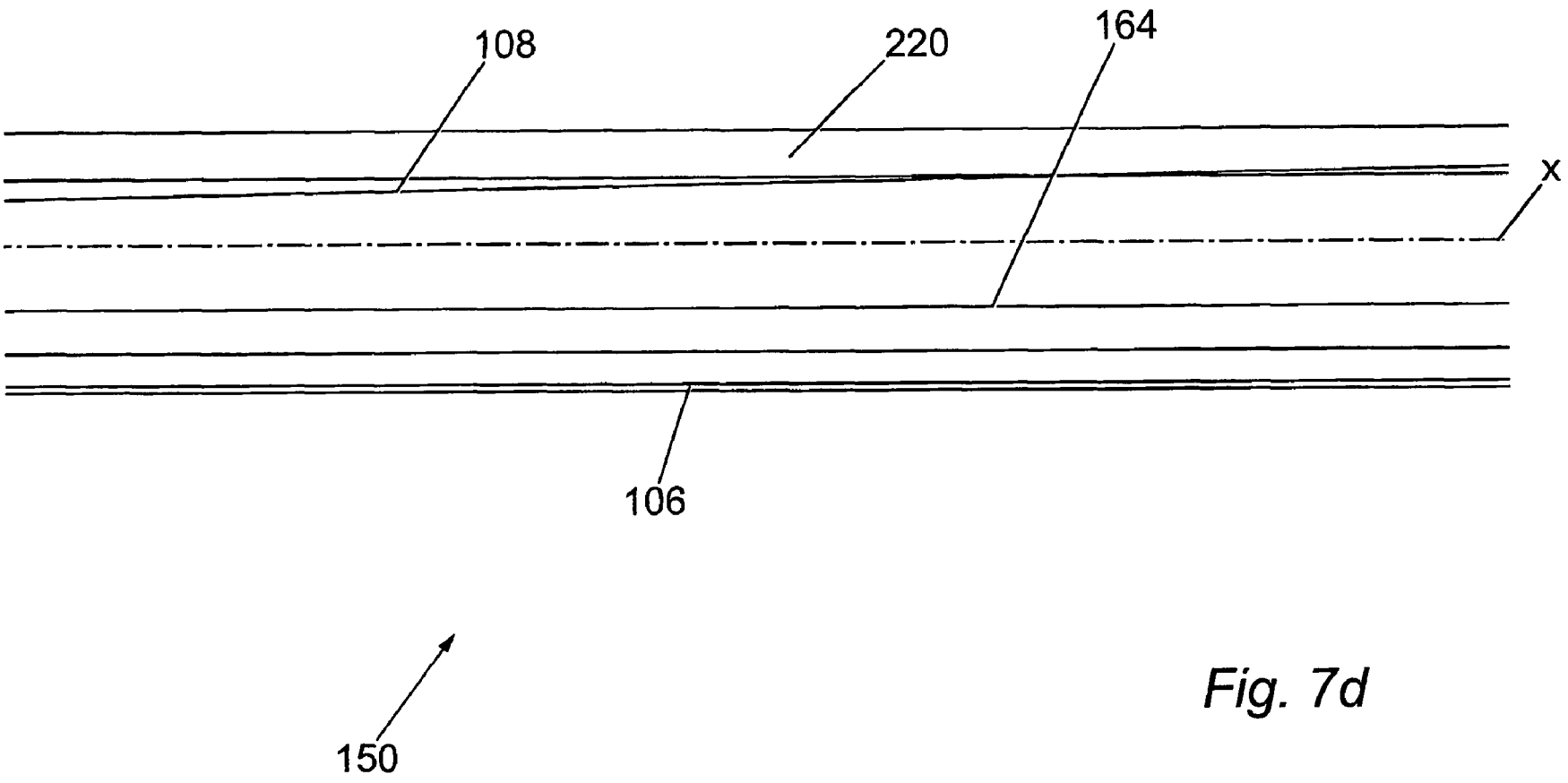
Figure 7E:
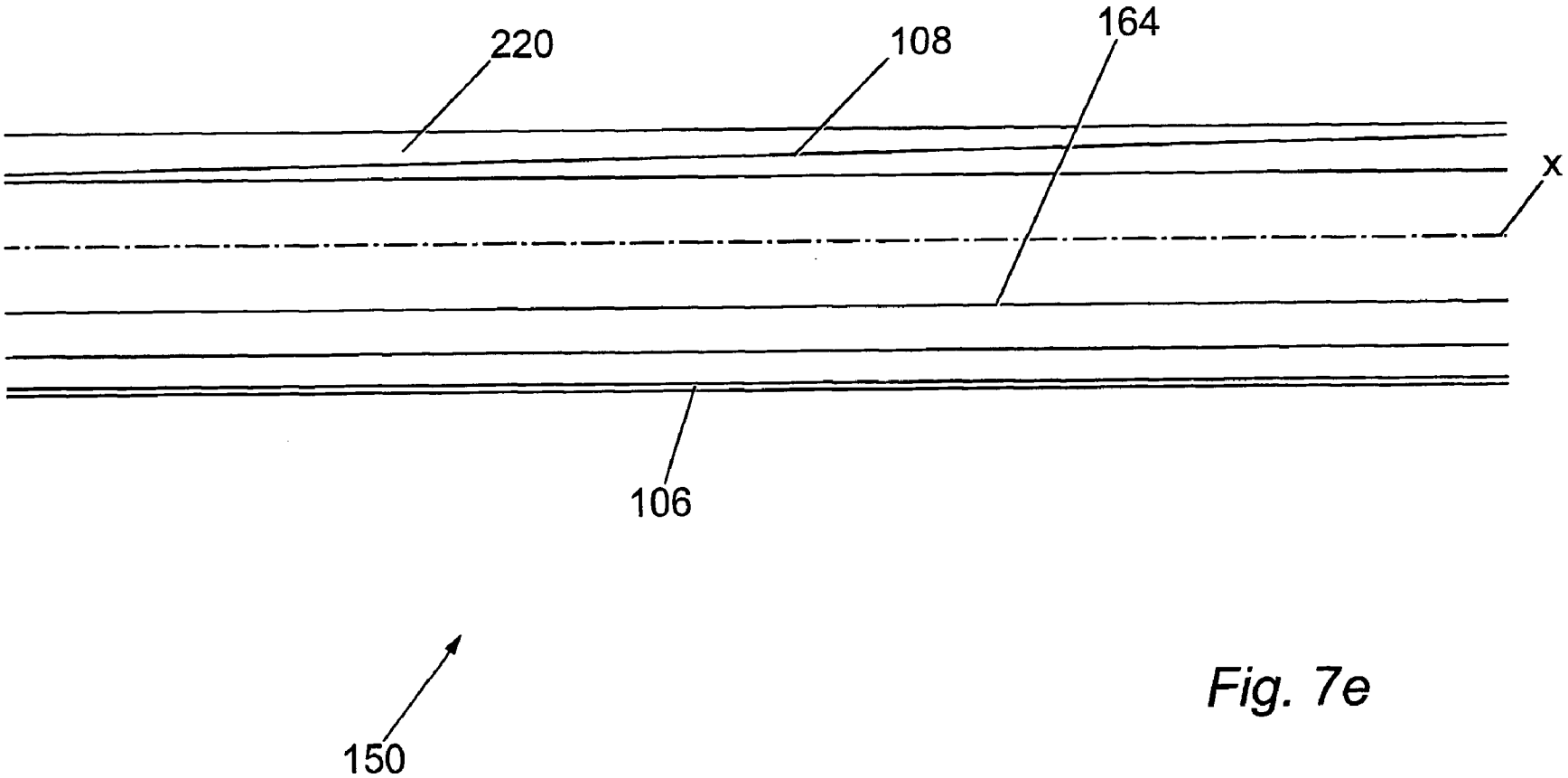
Figure 7F:
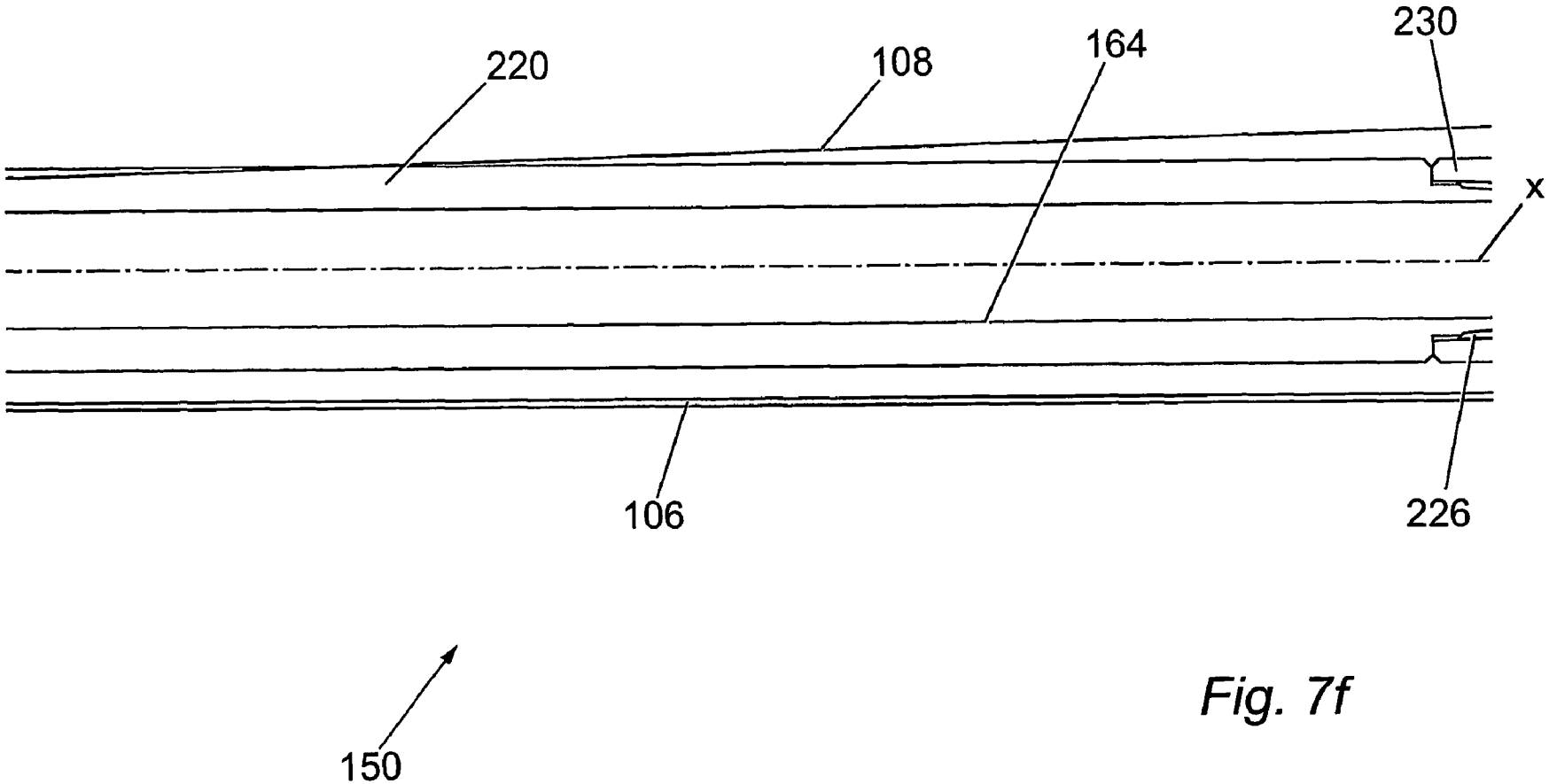

Referring now to FIGS. 7*b* and 7*c*, there is shown a retainer sub 200 that is threadedly engaged with the packer 156 at threads 202. The retainer sub 200 includes an annular piston 204 that can slide along an axis that is substantially parallel to the longitudinal axis x of the apparatus 150. The retainer sub 200 is provided with a port 206 that communicates fluid from outwith the apparatus 150 to a chamber 208. The fluid enters the chamber 208 forcing the piston 202 to the position shown in FIG. 7*c*. As the piston moves to the left in FIG. 7*c* under fluid pressure, an outer surface 202*s* of the piston 202 engages a number of radial pistons 210. FIG. 7*c* shows only two radial pistons 210, but it will be appreciated that four such pistons 210 are typically provided, each being circumferentially spaced-apart by 90°.

The radial pistons 210 are pushed outwardly by the outer surface 202*s* as the piston 202 moves to the left. An outer end 210*e* of the radial pistons 210 dimple an inner surface 106*i* of the conduit 106 and thus provide a means of locking or retaining the conduit 106 in place on the apparatus 150. Indeed, the retainer sub 200 also serves to centralise the conduit 106. It will be appreciated that the radial pistons 210 have been shown as protruding through the conduit 106, but the pistons 210 only require to dimple the inner surface 106*i* to retain the conduit 106 in place. The retainer sub 200 is typically actuated at the surface before the apparatus 150 is run in.

Figure 7G:
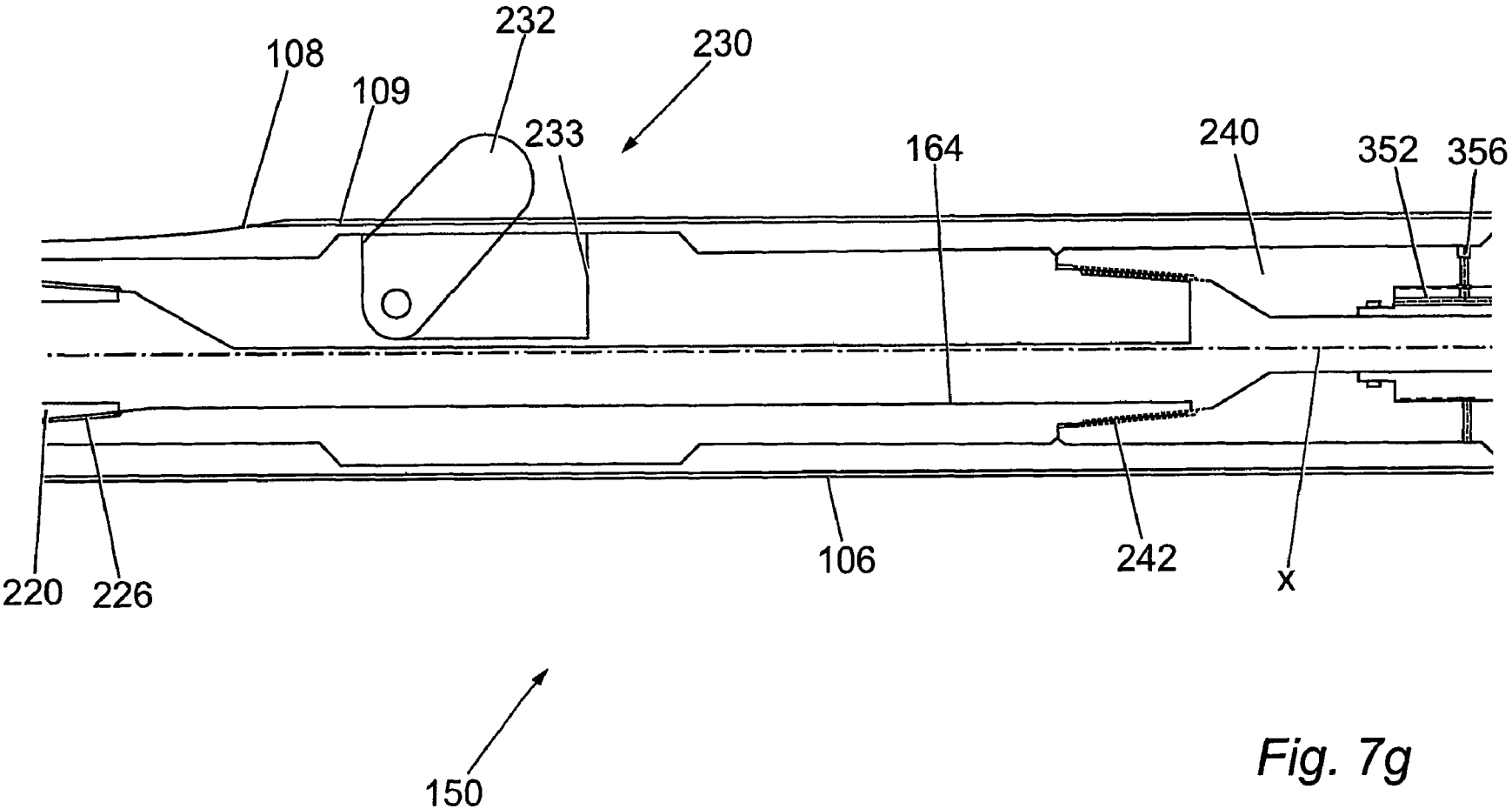

FIGS. 7*c* to 7*f* show an intermediate sub 220 that is threadedly engaged at a first end with the retainer sub 200 at threads 224, and threadedly engaged at a second end with a locator sub 230, best shown in FIG. 7*g*, at threads 226.

FIG. 7*g* shows a locator sub 230 that includes a spring-loaded locator arm 232. Arm 232 is normally biased to a radially extended position (as shown in FIG. 7*g*), but can be retracted into a slot 233 in the sub 230. The arm 232 is located in an elongate slot 109 of the aperture 108 in conduit 106 (FIG. 6*b*).

As the apparatus 150 is being run into the casing 100, the arm 232 is pushed back against the spring bias that tends to extend the arm 232. When the apparatus 150 approaches the opening 104 in casing 100, the spring loaded arm 232 springs outward through the opening 104 and locates the apparatus 150 at a lower end of the opening 104. The locator sub 230 thus ensures that the conduit 106 is located correctly before the ends 106*a*, 106*b* are radially expanded, as will be described.

Figure 7H:
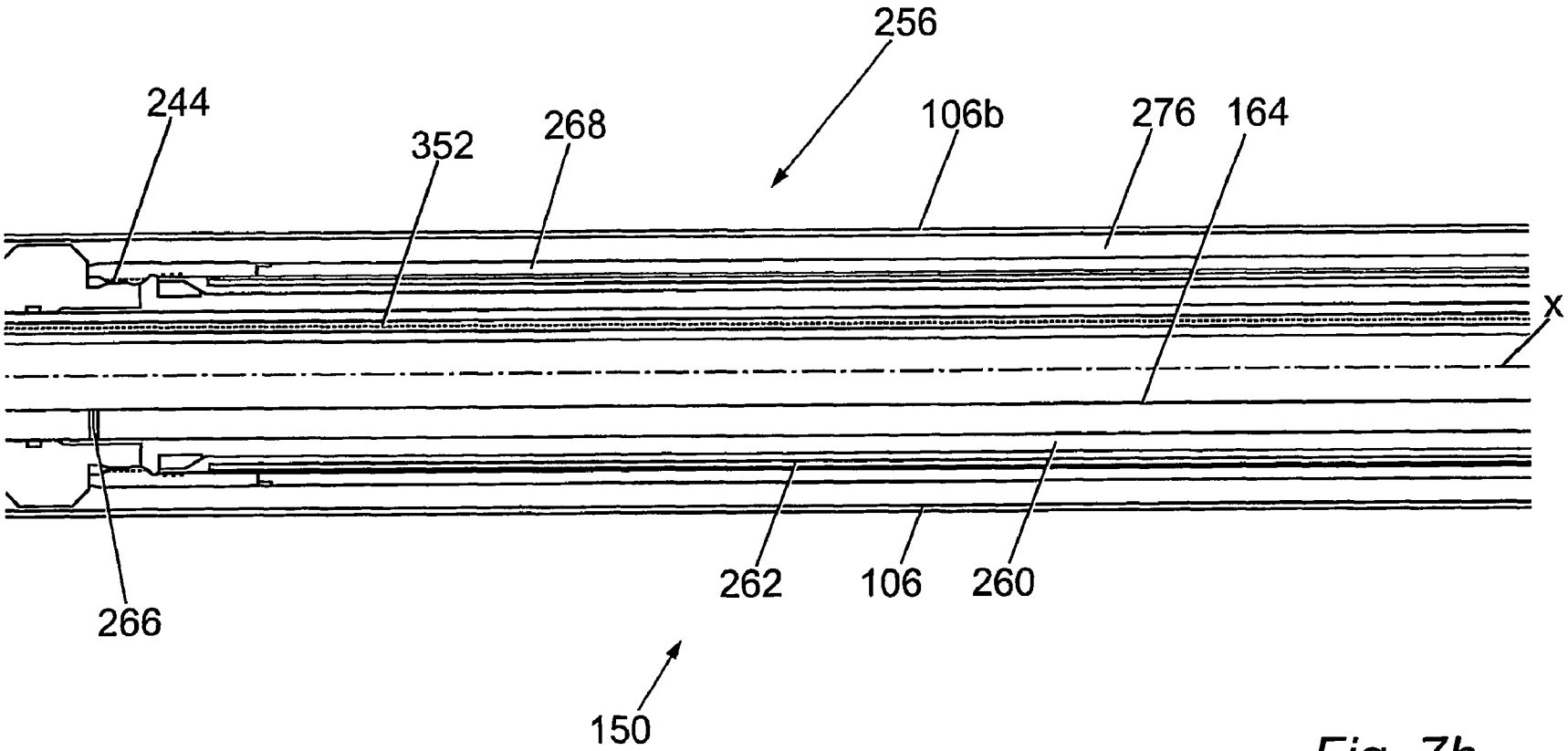

The locator sub 230 is threadedly engaged at a second end thereof with a second intermediate sub 240 at threads 242. Referring to FIG. 7*h*, the other end of the intermediate sub 240 is threadedly engaged with a second packer 256, which is substantially the same as the first packer 156, at threads 244. Like features of the packer 256 have been designated with the same reference numerals prefixed "2" instead of "1".

The second packer 256 is threadedly engaged at its second end with a third centraliser 290, which is substantially the same as the second centraliser 190, at threads 292. Like parts of the third centraliser 290 have been referenced with the same numeral prefixed "2" instead of "1".

The end 106*b* of the conduit 106 is swaged (FIG. 7*i*) to reduce the diameter thereof so that it engages an outer surface 268*s* of the elastomeric coating 268. This substantially prevents the ingress of fluid, dirt etc into the annulus 276 between the elastomeric covering 268 and the conduit 106 as the apparatus 150 is run into the casing 100. The first centraliser 170 (FIG. 7*a*) or the alternative centraliser 180 (FIG. 9) may used in place of, or in addition to, the swaged end 106*b*. Thus, a centraliser 170, 180 could be used at both ends 106*a*, 106*b* of the conduit 106.

Figure 7I:
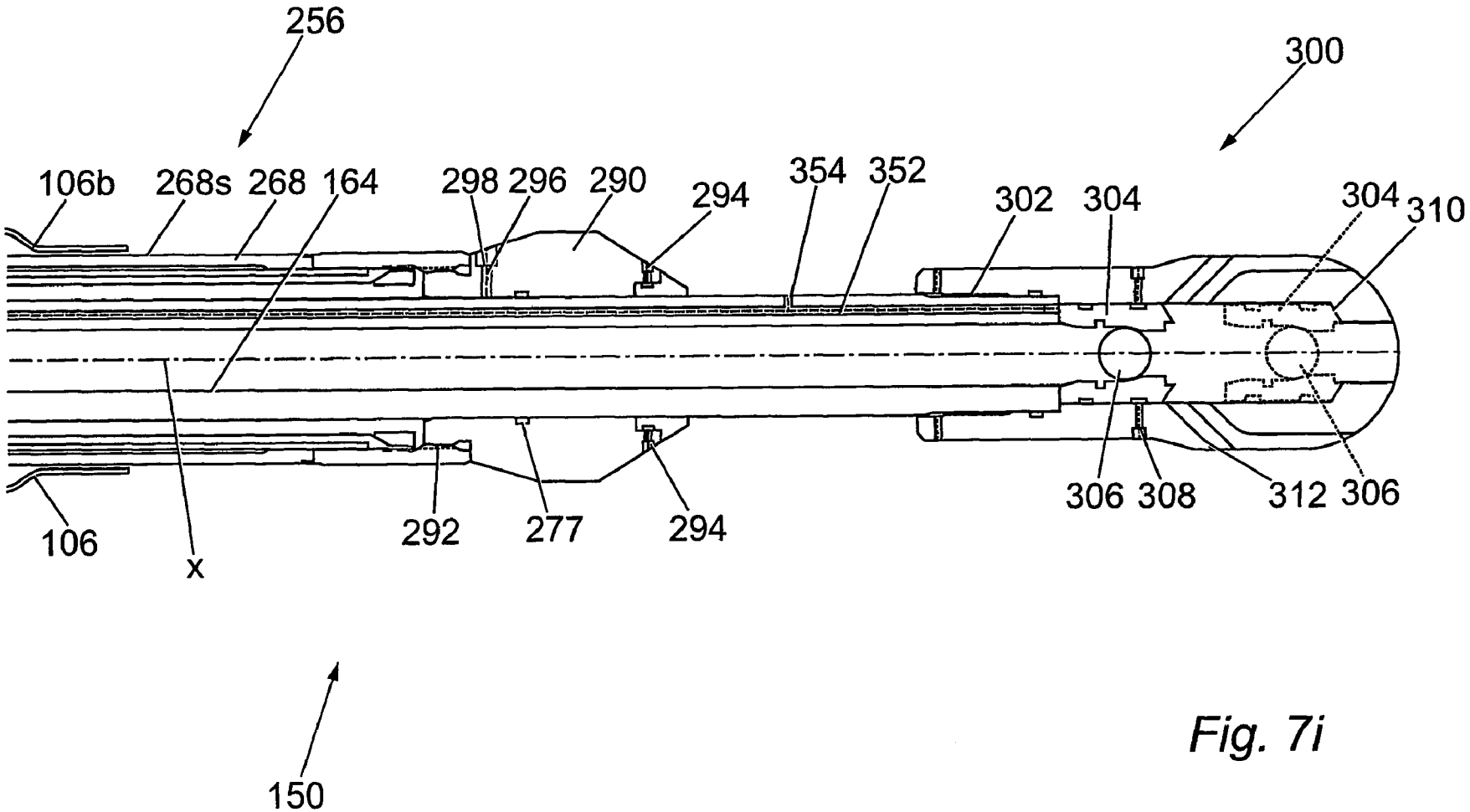

The second packer 256 is threadedly engaged at threads 302 with a ball catcher 300 (FIG. 7*i*). Ball catcher 300 is provided with a ball seat 304 that receives a ball 306 in use.

The ball seat 304 is provided with shear screws 308 that retain the seat 304 in contact with the ball catcher 300 until a pressure of around 3000 psi is applied to the ball seat 304. The catcher 300 has an annular shoulder 310 that retains the ball seat 304 when the shear screws 308 shear, as shown in phantom in FIG. 7*i*. The ball catcher 300 is also provided with circumferentially spaced-apart ports 312 that are used to bleed off pressure within the apparatus 150 as will be described. Four such ports 312 are typically provided, each port 312 being circumferentially spaced-apart from one another by around 90°.

Operation and use of the apparatus 150 shall now be described, with reference in particular to FIGS. 6*a* and 7*a* to 7*i*.

The apparatus 150 is assembled as described above and the conduit 106 is located over the apparatus 150 as shown in FIGS. 7*a* to 7*i*. In particular, the spring-loaded arm 232 is located in the elongated slot 109 of the aperture 108 in the conduit 106. The conduit 106 is held in place on apparatus 150 initially by the centraliser 170 (FIGS. 7*a* and 8) or the centraliser 180 (FIG. 9). Also, the swaged end 106*b* of the conduit 106 (FIG. 7*i*) engages the outer surface 268*s* of the elastomeric covering 268 of the second packer 256 that aids to keep the conduit 106 in place.

The conduit 106 is also held in place on the apparatus 150 by actuation of the retainer sub 200. A pressure source (e.g. a hydraulic hand pump or the like) is coupled to the port 206 and pressure is applied to the piston 202 to move it to the position shown in FIG. 7*c*. As the piston moves from right to left as shown in FIG. 7*c*, the piston 202 contacts the lower surface of the radial pistons 210 and pushes them radially outward so that the end 210*e* contacts and dimples the inner surface 106*i* of the conduit 106. The piston 202 is held in this position by locating a number of shear screws 209 (two shown in FIG. 7*c*) that lock the piston 202 in place. The shear screws 209 are typically rated to shear at a pressure of around 500 psi. Thus, the conduit 106 is rigidly attached to the apparatus 150 and also centralised with respect to the apparatus 150.

The apparatus 150 is then attached to a drill string, coiled tubing string or the like using the box connection 154. The apparatus 150 can then be run into the casing 100 on the drill string or coiled tubing string. As the apparatus 150 is being run in, the spring loaded arm 232 is compressed into slot 233 by engagement with the casing 100. However, when the apparatus reaches the opening 104 in casing 100, the arm 232 springs radially outward and engages a lower surface of the opening 104, thus correctly locating the conduit 106 and the apparatus 150.

The ball 306 is then dropped down the bore of the drill string or the coiled tubing string so that it passes through the bore 164 of the apparatus 150 and engages the ball seat 304, as shown in FIG. 7*i*. Pressure is then applied by pressuring up the bore of the drill string or coiled tubing string and the bore 164 against the ball 306. The pressure is typically in the order of 500 psi or more and is generally increased up to around 1400 psi or more to fully inflate the packers 156, 256.

As the pressure is increased over around 500 psi, fluid from the bore 164 enters the annular chambers 176, 276 of the packers 156, 256 through the ports 166, 266. The increase in pressure in chambers 176, 276 serves to push the metal plates 162, 262 outwardly against the elastomeric coverings 168, 268 that are also pushed outwardly. The outward movement of the elastomeric coverings 168, 268 continues until they engage the inner surface 106*i* of the conduit 106 at or near the ends 106*a*, 106*b*. Continued application of pressure into the annular chambers 176, 276 causes the elastomeric coverings 168, 268 to radially expand the ends 106*a*, 106*b* as shown in FIG. 6*a*, so that the ends 106*a*, 106*b* contact the inner surface of the casing 100. It will be appreciated that the conduit 106 shown in FIGS. 7*a* to 7*i* is not provided with a friction and/or sealing material 96, 110, although this can be provided.

The radial expansion of the ends 106*a*, 106*b* secures the conduit 106 in place around the opening 104 and the contact between the conduit 106 and the casing 100 provides a seal (optionally with a friction and/or sealing material 96, 110) that prevents the ingress of sand, silt, shale or the like into the main bore 100*b* of the casing 100. The flange for the hook hanger can then be landed on the aperture 108 in the conduit 106. This is advantageous as the size and shape of the aperture 108 will generally be constant and the flange of the hook hanger can be made to fit the aperture 108 easily. Also, as the ends 106*a*, 106*b* only of the conduit 106 are radially expanded, the radial expansion of these ends 106*a*, 106*b* should not interfere with the size and shape of the aperture 108.

As the packers 156, 256 inflate, the centraliser 170 (FIG. 7*a*) disengages from the O-ring 172 located in the groove 174. This is because an end 170*a* of the centraliser 170 is contacted first by the expansion of the elastomeric covering 168, 268, that serves to pivot or tilt the centraliser 170 around the end 170*a*. This pivoting or tilting pushes the opposite end 170*b* towards the elastomeric covering 168, 268 causing the O-ring 172 to be disengaged from the groove 174. Further expansion of the packers 156, 256 causes the centraliser 170 to be pushed towards the left in FIG. 7*a* so that it does not interfere with the radial expansion of the end 106*a*, although it will remain engaged with the apparatus 150 and can be retrieved from the casing 100 therewith.

Where centraliser 180 is used (FIG. 9), the relatively hard (and thus incompressible) rubber transfers the expansion force of the packer 156 as it expands to the end 106*a* of the conduit 106. This causes the end 106*a* to be radially expanded whilst the centraliser 180 remains in place on the apparatus 150 and can be withdrawn from the casing 100 therewith.

It will be appreciated that as the elastomeric coverings 168, 268 expand, they become shorter in the axial direction. Thus, the shear screws 194, 294 that retain the second and third centralisers 190, 290 in place shear off, and the second and third centralisers 190, 290 can move towards the left in FIGS. 7*b* and 7*i* as the coverings 168, 268 contract. It will be appreciated that as the apparatus 150 has been correctly located and the expansion process has begun, there is no requirement to keep the conduit 106 centralised with respect to the longitudinal axis x of the apparatus 150. The shear screws 194, 294 are typically rated to shear at around 500 psi.

It will also be appreciated that the conduit 106 does not need to be retained in contact with the apparatus 150 during the expansion process. Thus, and with reference to FIG. 7*c*, as the pressure reaches around 500 psi, the shear screws 209 shear and fluid enters an annular chamber 211 at the left hand side of the piston 202 through a port 213 that transfers pressure from the bore 164. The piston 202 is pushed to the right in FIG. 7*c* and the fluid pressure in chamber 208 is vented to outside the apparatus 150 through the port 206. As the piston 202 moves to the right, the outer surface 202*s* no longer engages the radial pistons 210 and they can move radially inward so that they no longer engage the conduit 106.

The pressure in bore 164 is increased causing the packers 156, 256 to expand the ends 106*a*, 106*b* until the pressure reaches around 3000 psi. At this pressure, the shear screws 308 that retain the ball seat 304 in the location shown in FIG. 7*i* shear, and the ball seat 304 is forced to the right to the position shown in phantom in FIG. 7*i*. The ball seat 304 engages the shoulder 310 so that it is retained within apparatus 150 for retraction from the casing 100 therewith. With the ball seat 304 having moved to engage the shoulder 310, this opens the ports 312 and allows pressure from within the bore 164 to be vented to outwith the apparatus 150. The venting of the pressure in the bore 164 allows the packers 156, 256 to deflate as the pressure in the annular chambers 176, 276 is vented into the bore 164 through ports 166, 266 and out of the apparatus 150 through the ports 312.

It will be appreciated that the inflation of the packer 256 can cause a seal in the annulus between the apparatus 150 and the casing 100 at or near the ball catcher 300, and it is sometimes the case that the ball seat 304 cannot be forced to the right as shown in FIG. 7*i* to release the pressure in the bore 164 because there exists a pressure lock or the like between the packer 256 and some point below ball catcher 300. In this case, the ball seat 304 will not move to the right as the pressure in the annulus around the ball catcher 300 is greater than the pressure within the bore 164.

However, the apparatus 150 is provided with pressure release channels 350, 352 that are located near the packers 156, 256 respectively (see FIGS. 7*a*, 7*b*, 7*c*, 7*g*, 7*h* and 7*i*). The release channels 350, 352 provide a path through the apparatus 150 that allows the pressure trapped at or near the ball catcher 300 to be vented to the left of the apparatus in FIG. 7*a*. The pressure at or near the ball catcher 300 enters the release channel 352 through a port 354 (FIG. 7*i*). The pressure then travels through the release channel 352 and by-passes the packer 256 to be vented to the annulus between the two intermediate subs 220, 240, the locating sub 230 and the conduit 106 through a port 356. The pressure then enters release channel 350 through a further port 358 (FIG. 7*b*) and travels through release channel 350 to be vented to the left of the apparatus 50 in FIG. 7*a* via a further port 360. This equalises the pressure around the apparatus 350 and allows the pressure within the bore 164 to be vented as the ball seat 304 can now move to engage shoulder 310, thus allowing the pressure to bleed off through ports 312 and also through the release channels 350, 352 if required. Thus, the packers 156, 256 can then deflate as described above.

In the event that the ball seat 304 cannot be moved under pressure to engage the shoulder 310 and thus vent the pressure in the bore 164, the pressure can be increased to around 4000 psi. At this pressure, the burst discs 198, 298 rupture and pressure can be vented from the bore 164 through the ports 166, 266 to the chambers 176, 276 where it is retained by an O-ring seal 177, 277 and thus vented to outwith the apparatus 150 through the ports 196, 296.

Thus, the present invention provides a method and apparatus for performing remedial and installation operations that in certain embodiments uses at least one inflatable element to expand portion of a lightweight and/or heavyweight expandable member. The present invention in certain embodiments also provides a method and apparatus for creating a conduit between an opening drilled into a casing to form a lateral borehole and a flange on a hook hanger.

Modifications and improvements may be made to the foregoing without departing from the scope of the present invention.

The invention claimed is:

1. A lateral tubular adapter apparatus, the apparatus having a longitudinal bore and comprising:

a conduit;

at least one expander element; and a retainer sub mounted on the conduit and having an array of radial pistons being circumferentially spaced-apart from one another.

2. Apparatus according to claim 1, having first and second axially spaced-apart expander elements.

3. Apparatus according to claim 1, wherein the at least one expander element comprises an inflatable element.

4. Apparatus according to claim 1, the apparatus having an annular chamber in fluid communication with the bore of the apparatus.

5. Apparatus according to claim 4, wherein the at least one inflatable element includes at least one port in fluid communication with the annular chamber.

6. Apparatus according to claim 5, wherein the at least one port includes a rupture disc therein.

7. Apparatus according to claim 1, the apparatus having an elastomeric covering over at least a portion thereof.

8. Apparatus according to claim 1, wherein at least a portion of the conduit is swaged.

9. A lateral tubular adapter apparatus having a longitudinal bore, the apparatus comprising:

at least one expander element having at least one inflatable element; and a centraliser located near the at least one inflatable element to control inflation of the at least one inflatable element.

10. A method of hanging a lateral tubular from casing in a borehole, the method comprising the steps of providing an apparatus that includes a conduit having a longitudinal bore and at least one expander element, the conduit having an aperture therein;

locating the conduit near a lateral opening in the casing of the borehole, wherein the locating includes providing a locating arm in an elongated portion of the aperture in the conduit, and running the apparatus into the borehole until the locating arm locates the lateral opening in the casing; and expanding the at least one expander element to radially expand portions of the conduit on opposite sides of the aperture.

11. A method according to claim 10, wherein the aperture in the conduit is teardrop-shaped.

12. A method of performing a downhole remedial operation, comprising:

running in an expandable tubular member into a wellbore, wherein the expandable tubular member includes a flow path in a wall thereof;

expanding a top portion of the expandable tubular member to seal against the wellbore;

expanding a bottom portion of the expandable tubular member to seal against the wellbore; and producing fluid through the flow path, the fluid disposed between an annular area formed by an unexpanded middle portion of the expandable tubular member and a wall of the wellbore.

13. The method according to claim 12, wherein the top and bottom portions are lightweight and the middle portion is heavyweight.

14. The method according to claim 12, wherein the top and bottom portions include a sealing material disposed on an outer surface thereof.

15. The method according to claim 12, wherein running in the expandable tubular member includes locating the middle portion concentrically within a valve in the wellbore, the valve allowing fluid to enter the wellbore.

16. The method according to claim 12, wherein running in the expandable tubular member includes locating the middle portion concentrically within a gas lift valve in the wellbore, the gas lift valve allowing fluid to enter the wellbore.

* * * * *